US011034156B2

(12) United States Patent
Maeshima

(10) Patent No.: US 11,034,156 B2
(45) Date of Patent: Jun. 15, 2021

(54) INKJET RECORDING APPARATUS

(71) Applicant: KYOCERA Document Solutions Inc., Osaka (JP)

(72) Inventor: Masanobu Maeshima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/582,670

(22) Filed: Sep. 25, 2019

(65) Prior Publication Data

US 2020/0094567 A1 Mar. 26, 2020

(30) Foreign Application Priority Data

Sep. 26, 2018 (JP) ..... JP2018-180515

(51) Int. Cl.
*B41J 2/175* (2006.01)
*B41J 29/13* (2006.01)

(52) U.S. Cl.
CPC ..... *B41J 2/17513* (2013.01); *B41J 2/17596* (2013.01); *B41J 29/13* (2013.01)

(58) Field of Classification Search
None
See application file for complete search history.

(56) References Cited

U.S. PATENT DOCUMENTS 7,407,241 B2 * 8/2008 Mutoh ..... B41J 2/17596 347/5
8,991,416 B2 * 3/2015 Bresnahan ..... F16K 17/26 137/112
2010/0154896 A1 * 6/2010 Thrash, Jr. ..... E21B 33/06 137/112
2016/0214393 A1 7/2016 Matsui et al.
2017/0106659 A1 4/2017 Matsui et al.
2018/0229508 A1 8/2018 Matsui et al.

FOREIGN PATENT DOCUMENTS

JP 2016132222 A 7/2016

* cited by examiner

*Primary Examiner* — Alejandro Valencia
(74) *Attorney, Agent, or Firm* — Alleman Hall Creasman & Tuttle LLP

(57) ABSTRACT

In an inkjet recording apparatus, ink reserved in a reserve portion flows into a valve chamber through an inflow port. A first outflow port and a second outflow port are capable of flowing the ink from the valve chamber. The first valve element is preliminarily located at an opening position separated from the first outflow port in an inward direction directed from the first outflow port toward inside of the valve chamber. The first valve element is displaced from the opening position to the first outflow port and closes the first outflow port when the valve chamber is filled with the ink. The second valve element is preliminarily located at a closing position closing the second outflow port, and opens the second outflow port when the valve chamber is filled with the ink. Subsequently, a recording head becomes ready to record an image on a recording object with the ink.

8 Claims, 16 Drawing Sheets

INKJET RECORDING APPARATUS

INCORPORATION BY REFERENCE

This application is based upon and claims the benefit of priority from the corresponding Japanese Patent Application No. 2018-180515 filed on Sep. 26, 2018, the entire contents of which are incorporated herein by reference.

BACKGROUND

The present disclosure relates to an inkjet recording apparatus for recording an image on a recording object with ink.

In general, in an inkjet recording apparatus (hereinafter may be merely referred to as a recording apparatus), ink is reserved in a reserve portion such as a buffer tank. The ink is supplied from the buffer tank to a recording head. The ink is ejected from the recording head to a sheet. This allows an image to be recorded on the sheet.

During a period after the recording apparatus is assembled in the factory and before it is installed on a user side, the ink is not reserved in the buffer tank, and a flow path extending from the buffer tank to the recording head is not filled with the ink. After the recording apparatus is installed on the user side, a main tank storing the ink is attached to the recording apparatus. Thereafter, the recording apparatus executes a setup process so that the recording apparatus can be used on the user side. In the setup process, the ink is moved from the main tank to the buffer tank, and the flow path that is on the downstream of the buffer tank is filled with the ink.

SUMMARY

An inkjet recording apparatus according to an aspect of the present disclosure includes a reserve portion, a casing, a first valve element, a second valve element, and a recording head. Ink is reserved in the reserve portion. An inflow port, a valve chamber, a first outflow port, and a second outflow port are formed in the casing. The inflow port communicates with the reserve portion. The ink that has flowed out from the reserve portion flows into the valve chamber through the inflow port. The first outflow port and the second outflow port are capable of flowing out the ink from the valve chamber. The first valve element is preliminarily located at an opening position that is separated from the first outflow port in an inward direction that is directed from the first outflow port toward inside of the valve chamber. The first valve element is displaced from the opening position to the first outflow port so as to close the first outflow port when the valve chamber is filled with the ink. The second valve element is preliminarily located at a closing position closing the second outflow port, and the second valve element opens the second outflow port when the valve chamber is filled with the ink. The recording head becomes ready to record an image on a recording object with the ink that flows out through the second outflow port after the second outflow port is opened by the second valve element.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings for the understanding of the present disclosure. It should be noted that the following embodiment is an example of a specific embodiment of the present disclosure and should not limit the technical scope of the present disclosure.

Figure 1:
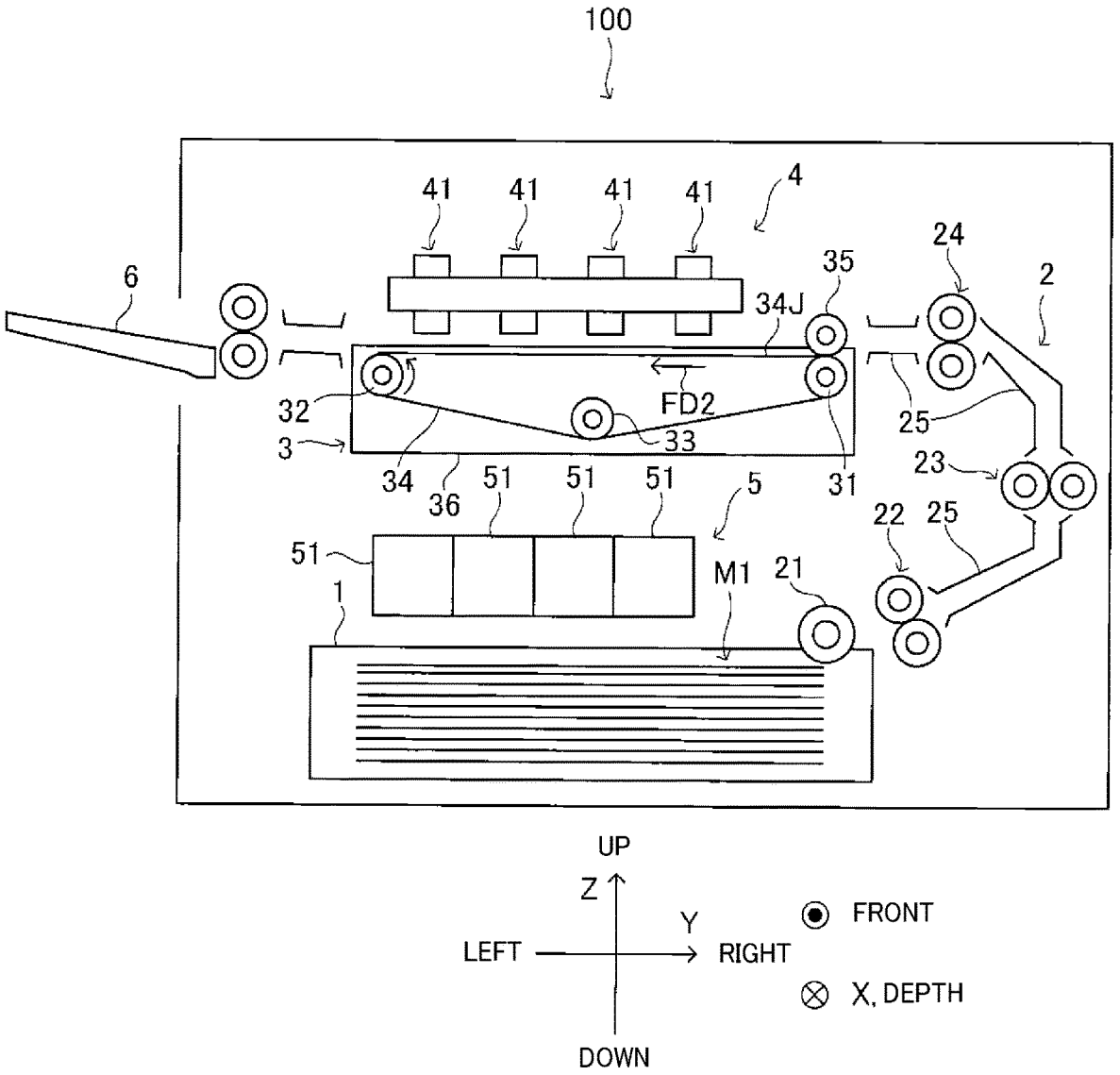
FIG. 1 is a schematic diagram showing an internal configuration of an inkjet recording apparatus according to an embodiment of the present disclosure.

Referring to FIG. 1, the arrow X indicates a depth direction which is directed from a front side to a depth side of an inkjet recording apparatus (hereinafter may be referred to as a recording apparatus) 100. The arrow Y indicates a width direction which is directed from a left side to a right side of the recording apparatus 100. The arrow Z indicates a height direction which is directed from a bottom side to a top side of the recording apparatus 100. Hereinafter, the depth direction, the width direction, and the height direction are respectively referred to as a depth direction X, a width direction Y, and a height direction Z.

Referring to FIG. 1, the recording apparatus 100 is, for example, an inkjet printer. The recording apparatus 100 records an image on a recording object M1 with ink based on image data. The image data is transmitted from an information processing apparatus (for example, a personal computer) that performs a data communication with the recording apparatus 100. The recording object M1 has a shape of a thin rectangular sheet. The recording object M1 is made of paper, cloth or the like. The recording apparatus 100 discharges the recording object M1 with the image recorded thereon to outside.

Figure 5:
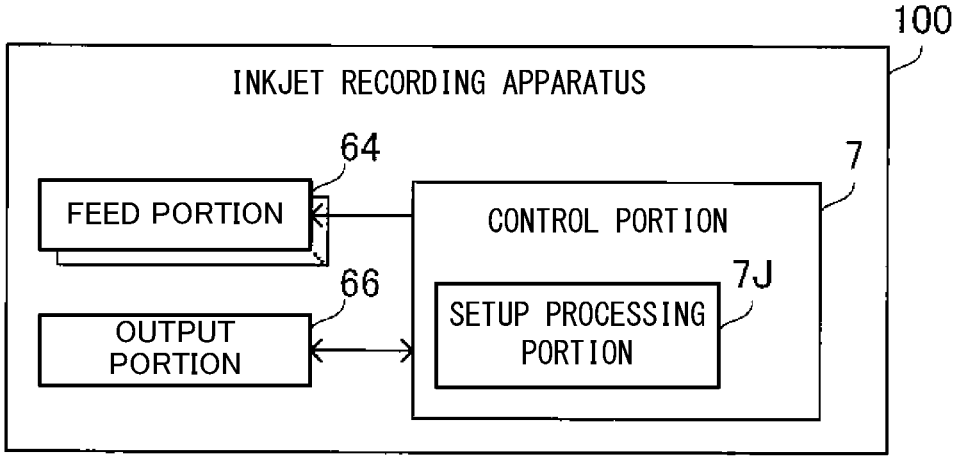
FIG. 5 is a block diagram showing a control portion included in the inkjet recording apparatus.

The recording apparatus 100 includes a storage portion 1, a feed portion 2, a conveyance portion 3, an image recording portion 4, an ink supply system 5, a discharge portion 6, and a control portion 7 (see FIG. 5).

The storage portion 1 is, for example, a supply tray. The storage portion 1 is provided at a lower location of the recording apparatus 100. The storage portion 1 stores a plurality of recording objects M1. The plurality of recording objects M1 are stored in the storage portion 1 such that a pair of opposite sides of each recording object M1 extend along the depth direction X. Hereinafter, the length of the pair of opposite sides is referred to as the width of the recording object M1.

The feed portion 2 is provided at a rightward position in the recording apparatus 100. In the feed portion 2, a pickup roller 21 picks up a recording object M1 and feeds it from the storage portion 1. In addition, in the feed portion 2, a pair of separation rollers 22 and a pair of conveyance rollers 23 feed the recording objects M1 one by one to a pair of registration rollers 24. In the feed portion 2, the pair of registration rollers 24 are provided at an upper right position in the recording apparatus 100. The pair of registration rollers 24 feed the recording object M1 fed from the pair of conveyance rollers 23, to the conveyance portion 3.

The conveyance portion 3 is provided above the storage portion 1 and on the left side of the pair of registration rollers 24 in the recording apparatus 100. The conveyance portion 3 includes a plurality of rollers: a tension roller 31, a drive roller 32, an auxiliary roller 33, and a suction roller 35. The conveyance portion 3 further includes a conveyance belt 34.

Each of the plurality of rollers has a cylindrical shape and is longer than the width of the recording object M1 in the depth direction X. Each of the plurality of rollers is supported by a frame 36 of the conveyance portion 3 so as to be rotatable around a center axis thereof.

The tension roller 31 is disposed on the left of the pair of registration rollers 24. The drive roller 32 is disposed on the left of the tension roller 31. The auxiliary roller 33 is disposed between the tension roller 31 and the drive roller 32 in the width direction Y. The auxiliary roller 33 is disposed below the tension roller 31 and the drive roller 32.

The conveyance belt 34 is an endless belt. The conveyance belt 34 is stretched among the tension roller 31, the drive roller 32, and the auxiliary roller 33. The width of the conveyance belt 34 in the depth direction X is larger than the width of the recording object M1.

The drive roller 32 rotates under the control of the control portion 7. The conveyance belt 34 rotates following the rotation of the drive roller 32. A top portion of an outer peripheral surface of the conveyance belt 34, namely a top surface 34J, runs in a conveyance direction FD2. The conveyance direction FD2 is opposite to the width direction Y.

The suction roller 35 is disposed above the tension roller 31. The suction roller 35 abuts on the top surface 34J of the conveyance belt 34 from above the conveyance belt 34. The suction roller 35 and the tension roller 31 hold the conveyance belt 34 in between.

The pair of registration rollers 24 feed a recording object M1 between the suction roller 35 and the conveyance belt 34. The suction roller 35, while rotating, causes the recording object M1 to be in close contact with the top surface 34J. The recording object M1 is conveyed by the conveyance belt 34 in the conveyance direction FD2 while in close contact with the top surface 34J.

The image recording portion 4 includes four recording heads 41. The four recording heads 41 correspond to yellow, black, cyan, and magenta. It is noted that the image recording portion 4 only needs to include one or more recording heads 41.

The recording heads 41 are disposed directly above the top surface 34J in the recording apparatus 100. The four recording heads 41 are aligned at intervals in the width direction Y. The length of the recording heads 41 in the width direction Y is longer than the width of the recording object M1.

Figure 2:
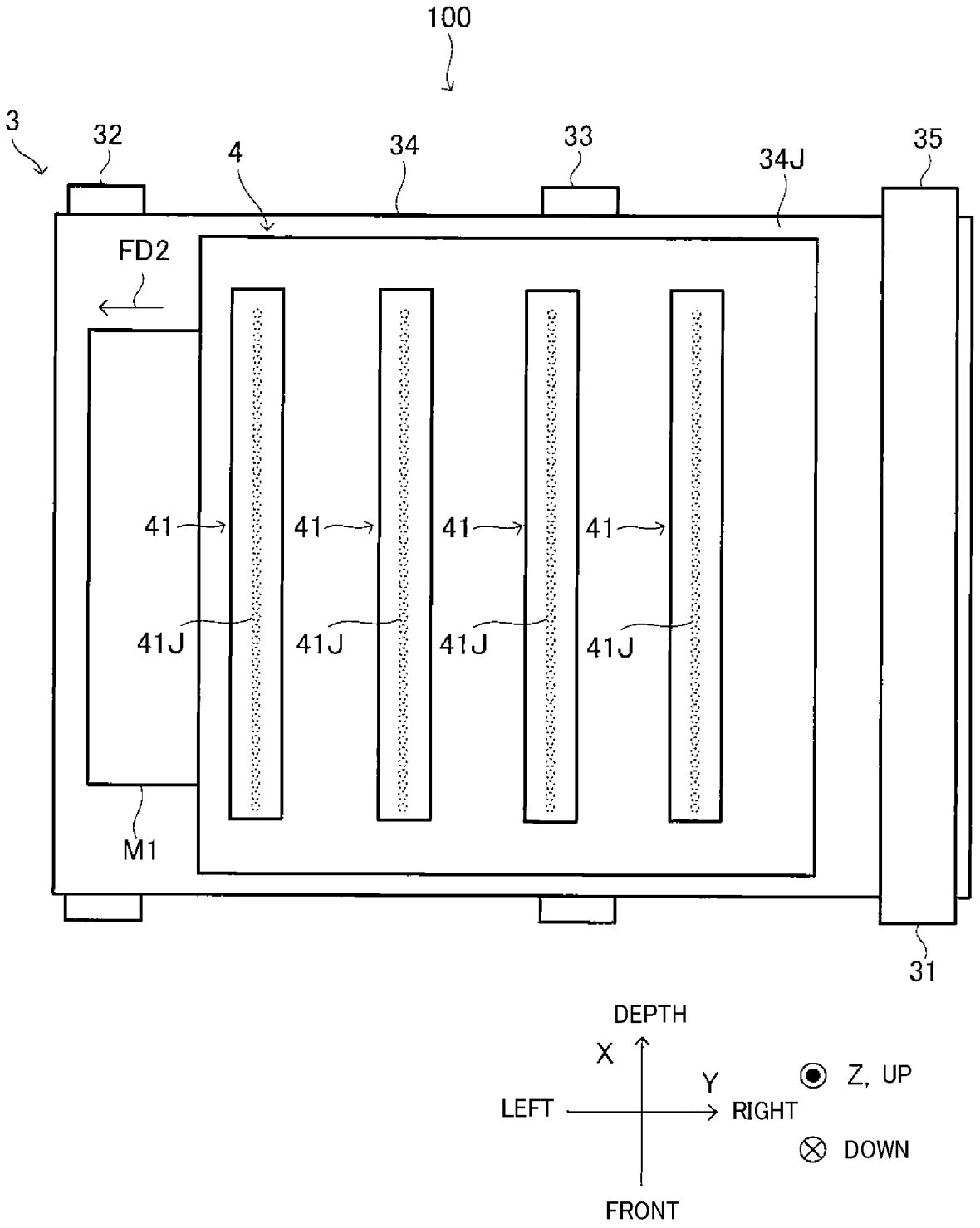
FIG. 2 is a schematic diagram showing ink ejection portions included in an image recording portion.

As shown in FIG. 2, each of the recording heads 41 includes a lot of ink ejection portions 41J that are aligned in the depth direction X. It is noted that in FIG. 2, the reference sign "41J" is placed at one ink ejection portion per recording head 41. It is noted that the ink ejection portions 41J may be arranged zigzag instead of linearly in the depth direction X in a plan view viewed from above.

Ink supply portions 52 (see FIG. 3) respectively supply ink of corresponding colors to the ink ejection portions 41J of the corresponding recording heads 41. The ink ejection portions 41J eject the ink to a recording object M1 when the recording object M1 is conveyed directly below the ink ejection portions 41J. This allows an image represented by the image data to be recorded on the recording object M1 with the ink of the four colors.

Referring to FIG. 1, the discharge portion 6 is a discharge tray provided outside the recording apparatus 100. Recording objects M1 with images recorded thereon are discharged to the discharge portion 6.

Figure 3:
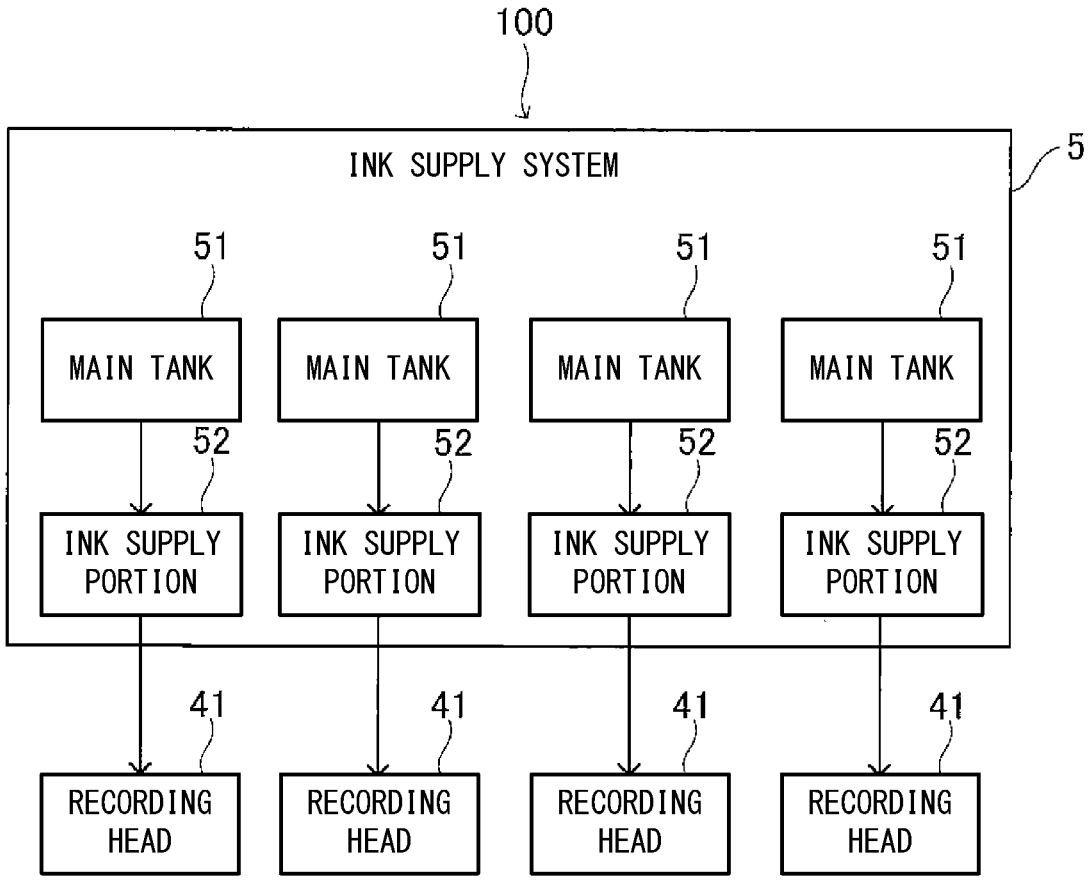
FIG. 3 is a block diagram showing a configuration of an ink supply system.

As shown in FIG. 3, the ink supply system 5 includes four main tanks 51. The four main tanks 51 respectively correspond to the four recording heads 41. Ink of a corresponding color is reserved in each main tank 51. The main tanks 51 are attached to the recording apparatus 100 in a detachable manner.

As shown in FIG. 3, the ink supply system 5 further includes four ink supply portions 52. The four ink supply portions 52 respectively correspond to the four main tanks 51 and the four recording heads 41. The ink supply portions 52 supply ink of corresponding colors reserved in the corresponding main tanks 51, to the corresponding recording heads 41.

Figure 4:
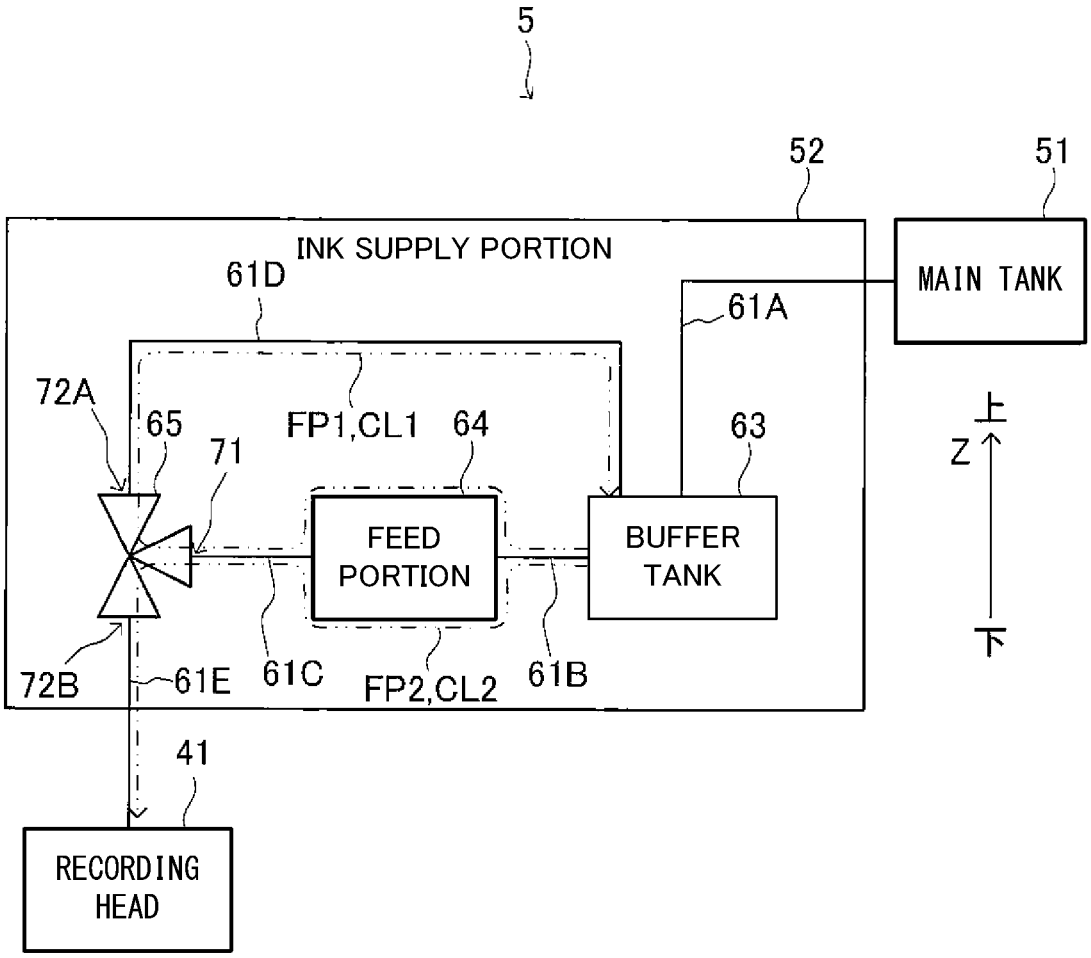
FIG. 4 is a block diagram showing a detailed configuration of an ink supply portion.

As shown in FIG. 4, each of the ink supply portions 52 includes flow path members 61A to 61E, a buffer tank 63, a feed portion 64, and a flow path switching device 65.

The flow path members 61A to 61E are each tubular. An ink flow path is formed in each of the flow path members 61A to 61E. It is noted that the flow path member 61D is connected to a first outflow side connection portion 72A. The operator can change the orientation of the first outflow side connection portion 72A (see FIG. 15). The flow path member 61D is made of a flexible material so that it can cope with the change of the orientation. On the other hand, the flow path members 61A to 61C and 61E may be made of the flexible material or may be made of a material other than the flexible material.

The buffer tank 63 is an example of a reserve portion of the present disclosure. The ink is reserved in the buffer tank 63. Specifically, the buffer tank 63 is disposed below the main tank 51. The ink reserved in the main tank 51 is supplied to, and reserved in, the buffer tank 63 via the flow path member 61A.

The feed portion 64 communicates with the buffer tank 63 via the flow path member 61B. The feed portion 64 communicates with the flow path switching device 65 via the flow path member 61C. The feed portion 64 feeds the ink from the buffer tank 63 to the flow path member 61B. In addition, the feed portion 64 receives the ink from the flow path member 61B and feeds it to the flow path member 61C. Specifically, the feed portion 64 is a syringe pump or a pump having a blade-like rotor. In this case, the feed portion 64 pressurizes the ink in the buffer tank 63 for the ink to be fed to the flow path member 61B.

Referring to FIG. 4, the flow path switching device 65 is a three-way valve. The flow path switching device 65 includes a inflow side connection portion 71, the first outflow side connection portion 72A, and a second outflow side connection portion 72B. A valve chamber 73J (see FIG. 6) is formed in the flow path switching device 65. A flow path communicating with the valve chamber 73J is formed in each of the inflow side connection portion 71, the first outflow side connection portion 72A, and the second outflow side connection portion 72B.

Specifically, a flow path FP11 (see FIG. 6) is formed in the inflow side connection portion 71, wherein the flow path FP11 communicates with the feed portion 64 via the flow path member 61C. The ink that flows through the flow path member 61C is fed into the valve chamber 73J through the flow path FP11. A flow path FP12A (see FIG. 6) is formed in the first outflow side connection portion 72A, wherein the flow path FP12A communicates with the buffer tank 63 via the flow path member 61D. A flow path FP12B (see FIG. 6) is formed in the second outflow side connection portion 72B, wherein the flow path FP12B communicates with the recording head 41 via the flow path member 61E.

When the flow path switching device 65 opens the flow path FP12A and closes the flow path FP12B, the ink fed into the valve chamber 73J through the flow path FP11 flows out from the valve chamber 73J through the flow path FP12A. In this case, in the ink supply portion 52, the ink fed out from the buffer tank 63 returns to the buffer tank 63 through a circulation flow path FP1 that is indicated by a two-dot chain line CL1 in FIG. 4. The circulation flow path FP1 includes the flow path member 61B, the feed portion 64, the flow path member 61C, the flow path switching device 65, and the flow path member 61D. The circulation flow path FP1 is used in a setup process that is described below.

When the flow path switching device 65 opens the flow path FP12B and closes the flow path FP12A, the ink fed into the valve chamber 73J flows out from the valve chamber 73J through the flow path FP12B. In this case, the ink fed out from the buffer tank 63 is supplied to the recording head 41 through a main flow path FP2 that is indicated by a two-dot chain line CL2 in FIG. 4. The main flow path FP2 includes the flow path member 61B, the feed portion 64, the flow path member 61C, the flow path switching device 65, and the flow path member 61E. The main flow path FP2 is used after the setup process is executed.

Referring to FIG. 5, the control portion 7 includes a processor and various types of memory devices. Specifically, the processor is a CPU, a microcomputer or the like. In addition, the various types of memory devices include a ROM, a RAM, and a nonvolatile memory. The processor executes, by using the RAM, a program that is preliminarily stored in the ROM or the like. This allows the control portion 7 to control the recording apparatus 100 comprehensively.

It is noted that the control portion 7 may include an electronic circuit such as an ASIC (Application Specific Integrated Circuit) or a DSP (Digital Signal Processor), instead of the CPU or the microcomputer.

During a period from when the recording apparatus 100 is assembled in the factory until it is installed on a user side, (1) the main tanks 51 (see FIG. 4) for the respective colors are not attached to the recording apparatus 100, (2) the ink is not reserved in the buffer tanks 63, and (3) the circulation flow paths FP1 and the main flow paths FP2 are not filled with the ink. It is noted that a part of the valve chambers 73J, the flow path members 61E, and the recording heads 41 are filled with a predetermined preservation solution. The preservation solution contains water and a water-soluble organic solvent that has surface activity and lower volatility than the water.

After the recording apparatus 100 is installed on the user side, the main tanks 51 are attached to the recording apparatus 100. In the recording apparatus 100, if air bubbles are contained in the ink ejected from the recording heads 41, the quality of the image may be degraded. For this reason, after the main tanks 51 are attached, the setup process is performed in the recording apparatus 100 to fill the flow paths on the downstream side of the buffer tanks 63 with the ink. The setup process is required to restrict air bubbles from remaining in the flow paths. In the present embodiment, the flow path switching devices 65 restrict the air bubbles from remaining in the flow paths that are on the downstream side of the buffer tanks 63, more specifically restrict the air bubbles from remaining in the flow path switching devices 65 included in the main flow paths FP2.

In the recording apparatus 100, for the purpose of restricting the air bubbles from remaining after the setup process, (1) the control portion 7 includes a setup processing portion 7J as shown in FIG. 5, and (2) each of the flow path switching devices 65 has a configuration which is shown in detail in FIG. 6 to FIG. 16.

Referring to FIG. 5, the control portion 7 functions as the setup processing portion 7J by executing the program. After the main tanks 51 (see FIG. 4) for the respective colors are attached to the recording apparatus 100 by the user side, the operator operates the recording apparatus 100 to execute the setup process.

The setup processing portion 7J starts the setup process in response to an operation performed by the operator. The setup processing portion 7J starts driving the feed portions 64 for the respective colors. This allows the ink to flow out from the main tanks 51 (see FIG. 4) and start being reserved in the buffer tanks 63 via the flow path members 61A. After a predetermined amount of ink is reserved in each of the buffer tanks 63, the ink starts to flow out from the buffer tanks 63. It is set such that at the start of the setup process, in each of the ink supply portions 52, the ink that has flowed out from the buffer tank 63 flows through the circulation flow path FP1. As a result, the circulation flow path FP1 is gradually filled with the ink.

After a specific time period elapses from the start of driving of the feed portions 64, the setup processing portion 7J notifies the operator that the circulation flow path FP1 has been filled with the ink (hereinafter the state is referred to as an "end of filling"), via an output portion 66 included in the recording apparatus 100. The specific time period is preliminarily determined through an experiment, a simulation or the like at the design developing stage of the recording apparatus 100. Specifically, the specific time period is determined based on the flow rate of the feed portion 64, the capacity of the circulation flow path FP1 or the like. The output portion 66 is a speaker or the like. In this case, the output portion 66 notifies the operator of the end of filling by means of a sound. It is noted that the output portion 66 may be a display. In this case, the output portion 66 notifies the operator of the end of filling by means of an image. By notifying the end of filling, the setup processing portion 7J urges the operator to switch the flow path in each ink supply portion 52 from the circulation flow path FP1 to the main flow path FP2. After notifying the end of filling, the setup processing portion 7J waits for the operator to switch the flow path to the main flow path FP2.

Figure 6:
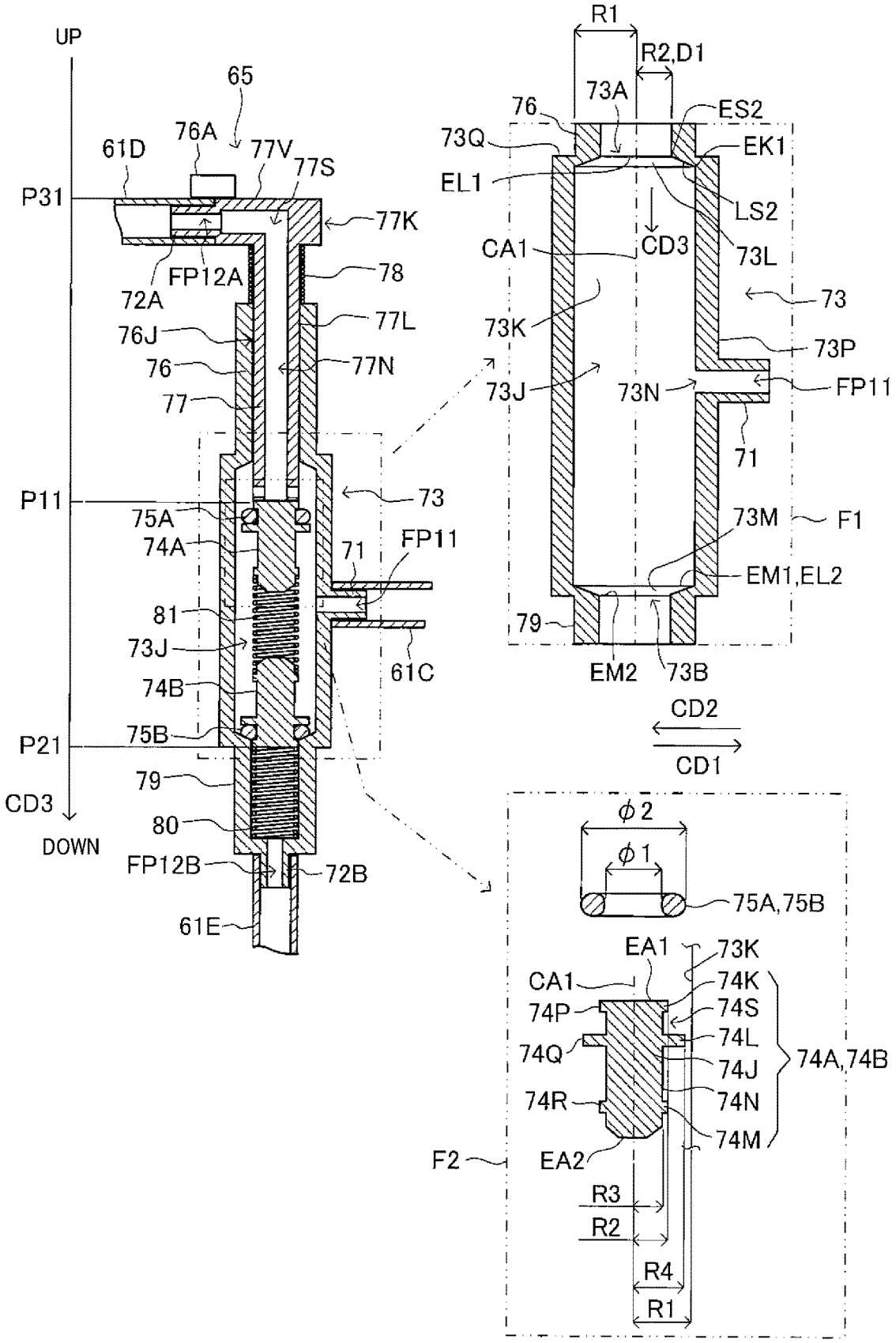
FIG. 6 is a schematic diagram showing an internal configuration of a flow path switching device, and showing a first valve element located at an opening position P11.
Figure 7:
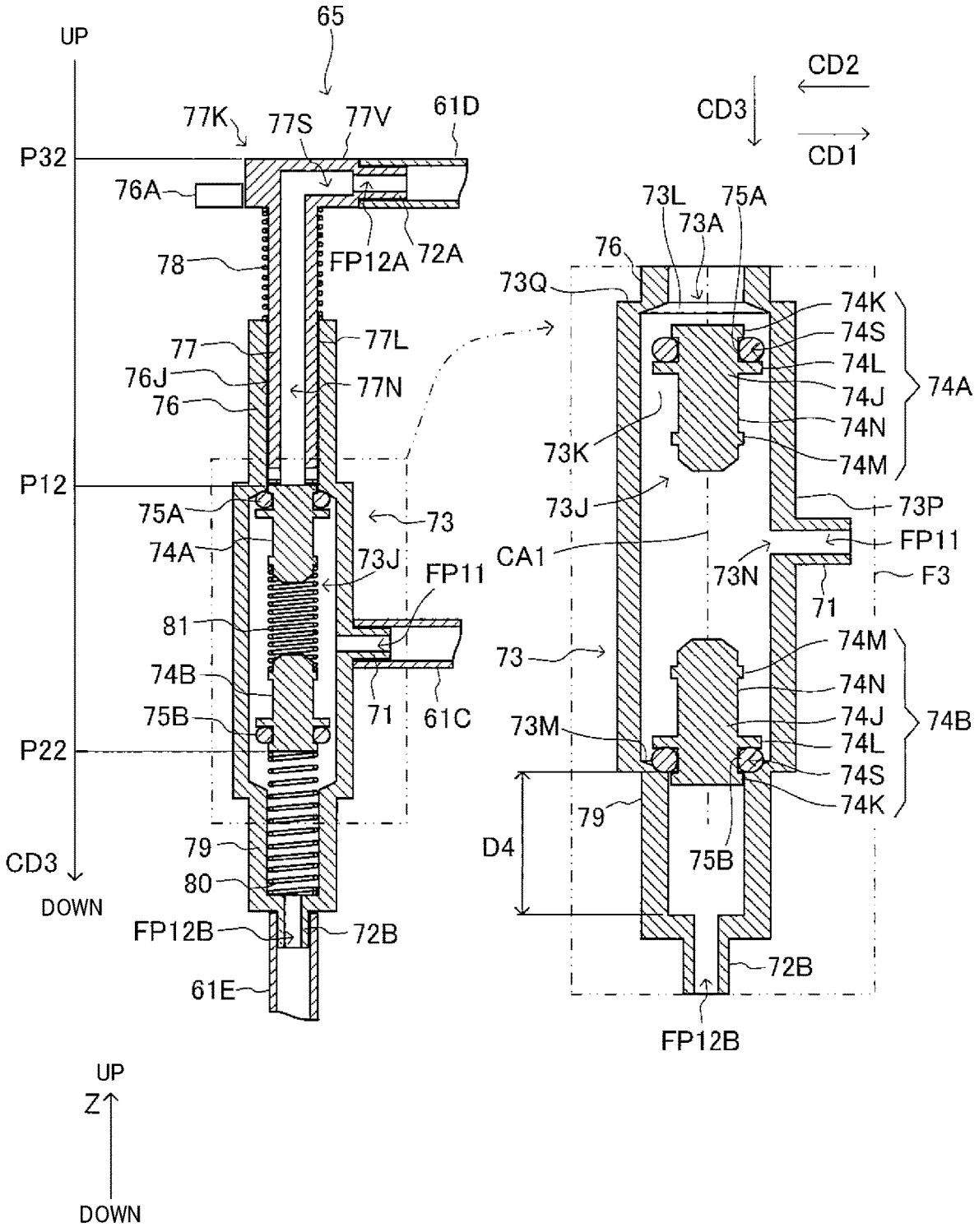
FIG. 7 is a schematic diagram showing an internal configuration of the flow path switching device, and showing the first valve element located at a closing position P12.

More specifically, as shown in FIG. 6 and FIG. 7, each flow path switching device 65 includes a casing 73, a first valve element 74A, a first seal member 75A, a second valve element 74B, a second seal member 75B, a guide portion 76, a flow path portion 77, a biasing member 78, a storage portion 79, a biasing member 80, and a link member 81.

The casing 73 is made of a hard material. The hard material is a hard resin, a metal or the like. The outer appearance of the casing 73 is approximately cylindrical. The valve chamber 73J is formed inside the casing 73. As shown in the frame F1 of FIG. 6, the valve chamber 73J is a space surrounded by an inner peripheral surface 73K, an inner upper surface 73L, and an inner lower surface 73M of the casing 73. An inflow port 73N, a first outflow port 73A, and a second outflow port 73B are further formed in the casing 73. It is noted that the casing 73, the guide portion 76, and the storage portion 79 are shown in the frame F1.

The inner peripheral surface 73K is a cylindrical surface having a core axis CA1 The core axis CA1 is parallel to the height direction Z. The radius of the inner peripheral surface 73K, namely a distance from the core axis CA1 to the inner peripheral surface 73K in a centrifugal direction CD1, is R1. The centrifugal direction CD1 is orthogonal to the height direction Z and is directed away from the core axis CA1. It is noted that in FIG. 6 or the like, only one example of the centrifugal direction CD1 is shown.

The inflow port 73N communicates with the buffer tank 63. Specifically, the inflow port 73N is formed in the inner peripheral surface 73K at a position close to a center of the inner peripheral surface 73K in the height direction Z. The inflow port 73N is opened toward the valve chamber 73J. The inflow side connection portion 71 projects from a portion of an outer surface 73P of the casing 73 that is separated from the inflow port 73N in the centrifugal direction CD1. The flow path member 61C is connected to the inflow side connection portion 71. In addition, in the inflow side connection portion 71, the flow path FP11 extends from the inflow port 73N in the centrifugal direction CD1 and passes through the inflow side connection portion 71. Ink that has flowed out from the buffer tank 63 and flowed through the flow path member 61C flows into the flow path FP11. Subsequently, the ink flows into the valve chamber 73J through the inflow port 73N. That is, the flow path member 61C, as an example of a first flow path member of the present disclosure, guides the ink reserved in the buffer tank 63 to the inflow port 73N.

The inner upper surface 73L is an example of a peripheral edge portion of the present disclosure. That is, the inner upper surface 73L includes a peripheral edge portion that, as a portion of the casing 73, surrounds the first outflow port 73A. Here, a direction directed from the first outflow port 73A toward the inside of the valve chamber 73J is referred to as an inward direction CD3. Specifically, the inward direction CD3 is orthogonal to the first outflow port 73A of a circular shape, and more specifically is a downward direction. The inner upper surface 73L is an annular surface that is inclined with respect to the inward direction CD3. More specifically, as a position on the core axis CA1 goes from the first outflow port 73A in the inward direction CD3, a distance between the core axis CA1 and the inner upper surface 73L in the centrifugal direction CD1 increases. That is, the diameter of the inner upper surface 73L increases as it goes from the first outflow port 73A in the inward direction CD3.

As shown in the frame F1 of FIG. 6, the inner upper surface 73L, more specifically, is a plane that is formed when a line segment LS2 makes a full rotation around the core axis CA1. The line segment LS2 extends diagonally upward with respect to a centripetal direction CD2 from an arbitrary position on an upper end EK1 of the inner peripheral surface 73K. An upper end ES2 of the line segment LS2 is separated from the core axis CA1 in the centrifugal direction CD1 by a distance D1 that is shorter than the radius R1. The centripetal direction CD2 is orthogonal to the height direction Z, and is directed toward the core axis CAL The first outflow port 73A is a circular space surrounded by an upper end EL1 of the inner upper surface 73L. A radius R2 of the first outflow port 73A is equal to the distance D1. The ink in the valve chamber 73J can flow out from the first outflow port 73A.

The inner upper surface 73L has a radius that increases as the inner upper surface 73L goes from the first outflow port 73A in the inward direction CD3. Thus, compared with a case where the inner upper surface 73L is a flat surface that is parallel to the centripetal direction CD2, it is more difficult for air bubbles to be adhered to the inner upper surface 73L. That is, air bubbles hardly remain in the valve chamber 73J. It is noted that the inner upper surface 73L may be a flat surface that is parallel to the centripetal direction CD2.

The inner lower surface 73M has a shape inverted from the inner upper surface 73L in the inward direction CD3. An upper end EM1 of the inner lower surface 73M connects to a lower end EL2 of the inner peripheral surface 73K. The second outflow port 73B is a circular space surrounded by a lower end EM2 of the inner lower surface 73M. As with the first outflow port 73A, the radius of the second outflow port 73B is R2. It is noted that the inner lower surface 73M may not have a shape inverted from the inner upper surface 73L in the inward direction CD3. The ink in the valve chamber 73J can flow out from the second outflow port 73B, too.

The first valve element 74A and the second valve element 74B are stored in the valve chamber 73J. The first valve element 74A and the second valve element 74B have the same outer appearance. Thus, in the following, only the outer appearance of the first valve element 74A is described.

As shown in the frame F2 of FIG. 6, the first valve element 74A includes a main body portion 74J, a small diameter regulating portion 74K, a large diameter regulating portion 74L, and a regulating portion 74M. The main body portion 74J includes an outer peripheral surface 74N that is a cylindrical surface. The outer peripheral surface 74N is stored in the valve chamber 73J such that the core axis of the outer peripheral surface 74N matches the core axis CA1. The radius of the outer peripheral surface 74N, namely a distance from the core axis CA1 to the outer peripheral surface 74N in the centrifugal direction CD1, is R3.

Each of the small diameter regulating portion 74K, the large diameter regulating portion 74L, and the regulating portion 74M has an annular shape. The small diameter regulating portion 74K, the large diameter regulating portion 74L, and the regulating portion 74M project in the centrifugal direction CD1 from respective positions on the outer peripheral surface 74N that are different from each other in the inward direction CD3, each forming a flange-like shape. Specifically, the small diameter regulating portion 74K is provided close to a top surface EA1 that is one of two opposite surfaces of the outer peripheral surface 74N. The regulating portion 74M is provided close to a bottom surface EA2 that is the other of the two opposite surfaces of the outer peripheral surface 74N.

The small diameter regulating portion 74K includes an outer peripheral surface 74P. The large diameter regulating portion 74L includes an outer peripheral surface 74Q. The regulating portion 74M includes an outer peripheral surface 74R. Each of the outer peripheral surfaces 74P, 74Q, and 74R is a cylindrical surface having the core axis CA1.

The small diameter regulating portion 74K and the large diameter regulating portion 74L regulate the position, in the inward direction CD3, of the first seal member 75A attached to the first valve element 74A.

In the small diameter regulating portion 74K, the radius of the outer peripheral surface 74P is the same as the radius R2 of the first outflow port 73A.

The outer peripheral surface 74Q of the large diameter regulating portion 74L is separated from the outer peripheral surface 74P in the inward direction CD3, and has a radius R4. The radius R4 is longer than the radius R2 of the outer peripheral surface 74P, and is shorter than the radius R1 of the inner peripheral surface 73K.

The link member 81 is attached to the first valve element 74A at a position close to the bottom surface EA2. The regulating portion 74M regulates the upper end position of the link member 81 in the height direction Z. It is noted that the link member 81 is described in detail below.

The outer peripheral surface 74R of the regulating portion 74M is located close to a lower end of the outer peripheral surface 74N, and is separated from the outer peripheral surfaces 74P and 74Q in the inward direction CD3. The radius of the outer peripheral surface 74R is longer than the radius R3 and shorter than the radius R1.

Referring to FIG. 7, the first valve element 74A is stored in the valve chamber 73J at a position higher than the second valve element 74B in the height direction Z. In addition, as shown in the frame F3 of FIG. 7, the first valve element 74A is stored such that the small diameter regulating portion 74K is closer to the first outflow port 73A than the large diameter regulating portion 74L. This allows the small diameter regulating portion 74K of the first valve element 74A to enter and close the first outflow port 73A. The ink flows between the first valve element 74A and the inner peripheral surface 73K. It is noted that for the sake of convenience, in the frame F3, only the first valve element 74A and the second valve element 74B are shown in the valve chamber 73J.

The second valve element 74B is stored such that the small diameter regulating portion 74K is closer to the second outflow port 73B than the large diameter regulating portion 74L. This allows the small diameter regulating portion 74K to enter and close the second outflow port 73B. The ink flows between the second valve element 74B and the inner peripheral surface 73K.

Figure 8:
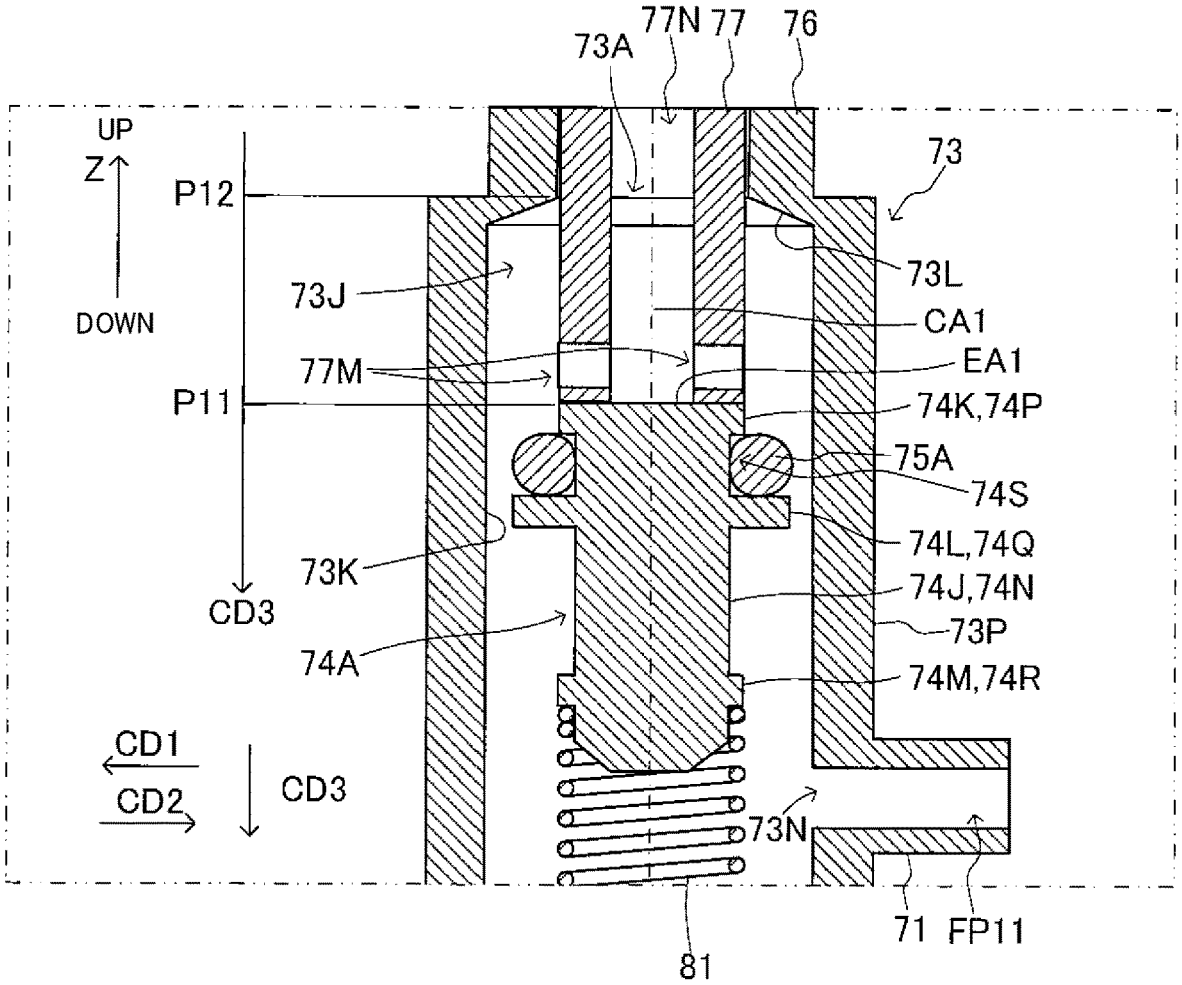
FIG. 8 is a schematic diagram showing in enlargement the first valve element located at the opening position P11.

The first valve element 74A is located at an opening position P11 at the time of shipment from the factory. Thus the first valve element 74A is located at the opening position P11 at the start of the setup process, as shown in FIG. 8. That is, the first valve element 74A is preliminarily located at the opening position P11. Specifically, the top surface EA1 of the first valve element 74A is located at the opening position P11 is. The opening position P11 is an example of an opening position of the present disclosure. The opening position P11 is separated from the first outflow port 73A in the inward direction CD3, and when the first valve element 74A is located at the opening position P11, the first outflow port 73A is opened.

Figure 9:
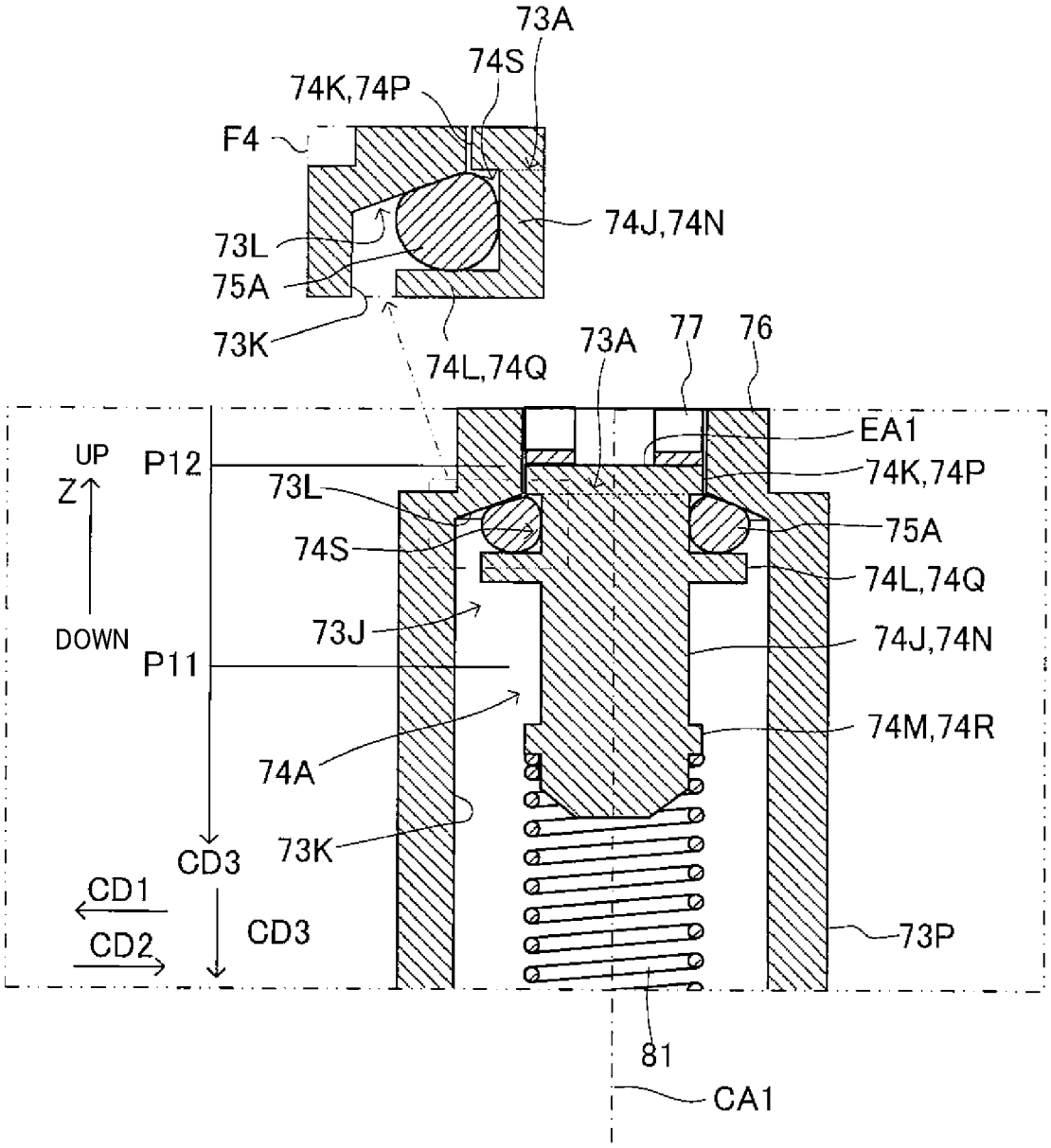
FIG. 9 is a schematic diagram showing in enlargement the first valve element located at the closing position P12.

In addition, as shown in FIG. 9, after the setup process is completed, the top surface EA1 of the first valve element 74A is located at a closing position P12. When the first valve element 74A is located at the closing position P12, the first outflow port 73A is closed. When the first valve element 74A is located at the closing position P12, the small diameter regulating portion 74K enters the first outflow port 73A, and closes the first outflow port 73A.

Figure 10:
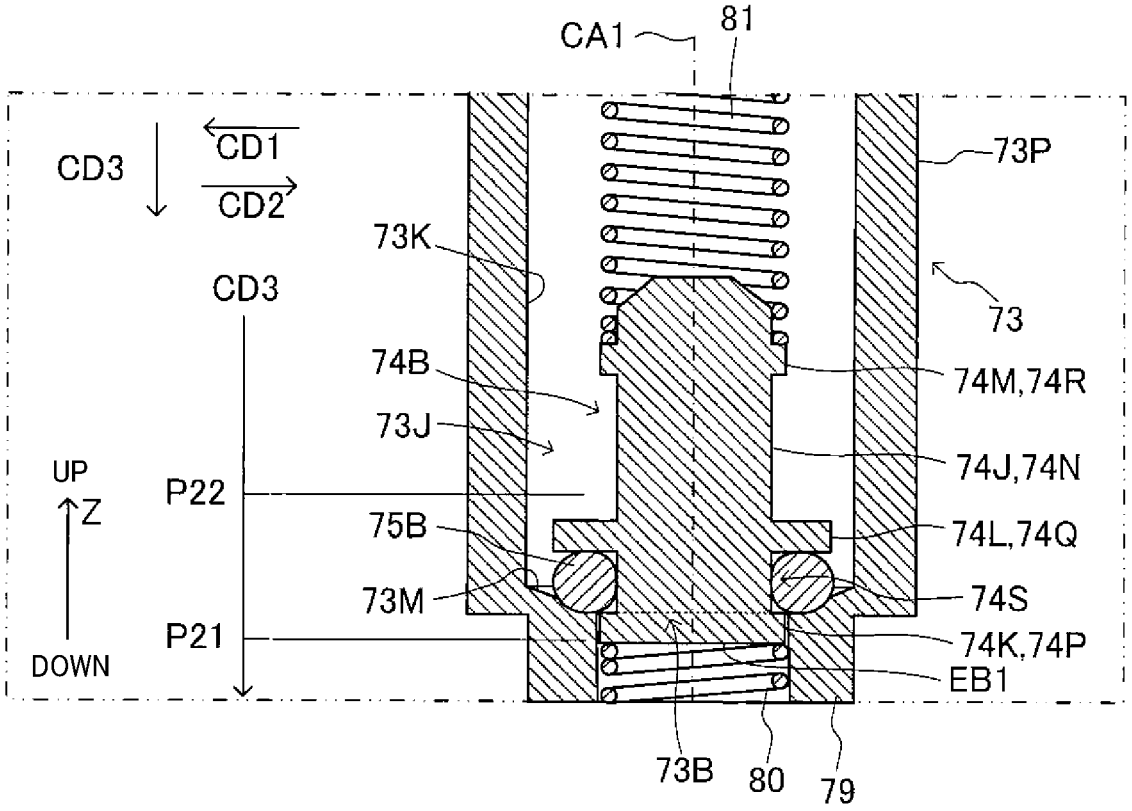
FIG. 10 is a schematic diagram showing in enlargement a second valve element located at a closing position P21.

In addition, the second valve element 74B is located at a closing position P21 at the start of the setup process, as shown in FIG. 10. Specifically, a bottom surface EB1 of the second valve element 74B is located at the closing position P21 is. The closing position P21 is an example of a closing position of the present disclosure. When the second valve element 74B is located at the closing position P21, the second outflow port 73B is closed. When the second valve element 74B is located at the closing position P21, the small diameter regulating portion 74K of the second valve element 74B enters and closes the second outflow port 73B. When the first valve element 74A is located at the opening position P11 (see FIG. 8), the second valve element 74B is located at the closing position P21.

Figure 11:
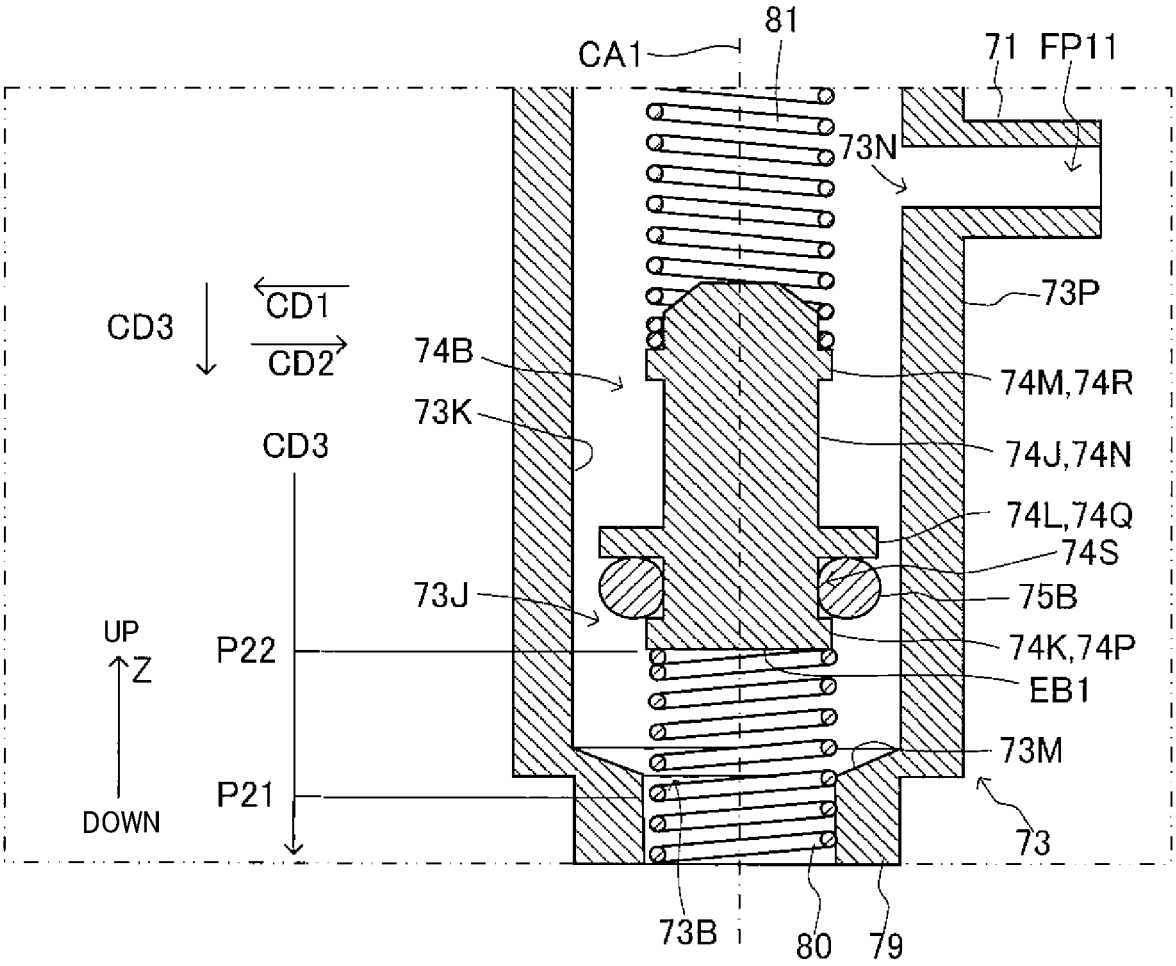
FIG. 11 is a schematic diagram showing in enlargement the second valve element located at an opening position P22.

In addition, as shown in FIG. 11, after the setup process is completed, the bottom surface EB1 of the second valve element 74B is located at a predetermined opening position P22. When the second valve element 74B is located at the opening position P22, the second outflow port 73B is opened. The opening position P22 is separated from the second outflow port 73B in an outward direction opposite to the inward direction CD3, namely separated in the height direction Z, and when the second valve element 74B is located at the opening position P22, the second outflow port 73B is opened. When the first valve element 74A is located at the closing position P12 (see FIG. 9), the second valve element 74B is located at the opening position P22.

The first seal member 75A and the second seal member 75B are circular rings made of rubber or the like, and are elastically deformed upon receiving a pressure. The first seal member 75A and the second seal member 75B may have the same specifications. Specifically, as shown in the frame F2 of FIG. 6, in a no-pressure state where no pressure is applied, the first seal member 75A and the second seal member 75B each have an inner diameter $\varphi 1$ that is equal to or smaller than $2\times R3$. In addition, in the no-pressure state, the first seal member 75A and the second seal member 75B each have an outer diameter $\varphi 2$ that is equal to or larger than $2\times R2$ and smaller than $2\times R1$.

The first seal member 75A is an example of a seal member of the present disclosure. The first seal member 75A is inserted around the first valve element 74A at a position close to the upper end. Specifically, the first seal member 75A is fitted in a groove 74S (see the frame F3 of FIG. 7) formed on the first valve element 74A. The groove 74S of the first valve element 74A is a concave surrounded by the main body portion 74J, the small diameter regulating portion 74K, and the large diameter regulating portion 74L of the first valve element 74A. The second seal member 75B is inserted around the second valve element 74B at a position close to the lower end. The groove 74S of the second valve element 74B is a concave surrounded by the main body portion 74J, the small diameter regulating portion 74K, and the large diameter regulating portion 74L of the second valve element 74B.

As shown in FIG. 9, when the first valve element 74A is located at the closing position P12, the small diameter regulating portion 74K of the first valve element 74A enters the first outflow port 73A. In addition, at this time, the first valve element 74A is biased in the height direction Z by the link member 81 or the like. As a result, as shown in the frame F4 of FIG. 9, the first seal member 75A comes in close contact with the inner upper surface 73L, namely with the peripheral edge portion, and hermetically seals the first outflow port 73A so that the ink in the valve chamber 73J does not leak therefrom.

As shown in FIG. 10, when the second valve element 74B is located at the closing position P21, the small diameter regulating portion 74K of the second valve element 74B enters the second outflow port 73B. At this time, the second valve element 74B is biased in the inward direction CD3 by the link member 81 or the like, and the second seal member 75B comes in close contact with the inner lower surface 73M, and hermetically seals the second outflow port 73B so that the ink in the valve chamber 73J does not leak therefrom.

Figure 12:
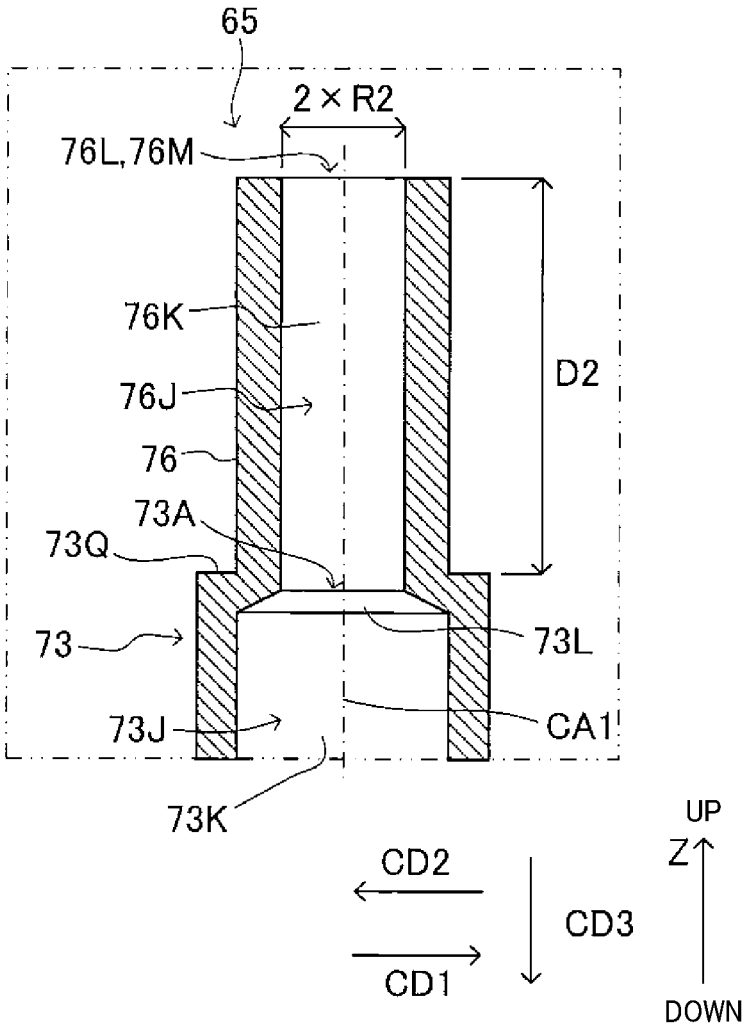
FIG. 12 is a schematic diagram showing a detailed configuration of a guide portion.

As shown in FIG. 12, the guide portion 76 has a shape of a bottomless cylinder. Specifically, the guide portion 76 extends from a portion of a top surface 73Q of the casing 73 that is separated from the valve chamber 73J in the height direction Z. The guide portion 76 extends between the top surface 73Q and a position that is separated from the top surface 73Q in the height direction Z by a distance D2.

A guide path 76J is formed in the guide portion 76. The guide path 76J is a space defined by an inner peripheral surface 76K of the guide portion 76. The guide path 76J guides, in the up-down direction, the flow path portion 77 that is movably inserted in the guide path 76J. The inner peripheral surface 76K is a cylindrical surface whose core axis is the same as the core axis CA1 of the valve chamber 73J. The diameter of the inner peripheral surface 76K, namely the diameter of the guide path 76J, is 2×R2. The guide path 76J extends in the height direction Z from the first outflow port 73A. An extension end 76L, namely an end portion of the guide path 76J in the height direction Z, is an opening 76M opened in the height direction Z. It is noted that for convenience of the explanation, the flow path portion 77 and the first valve element 74A are not shown in FIG. 12.

Figure 13:
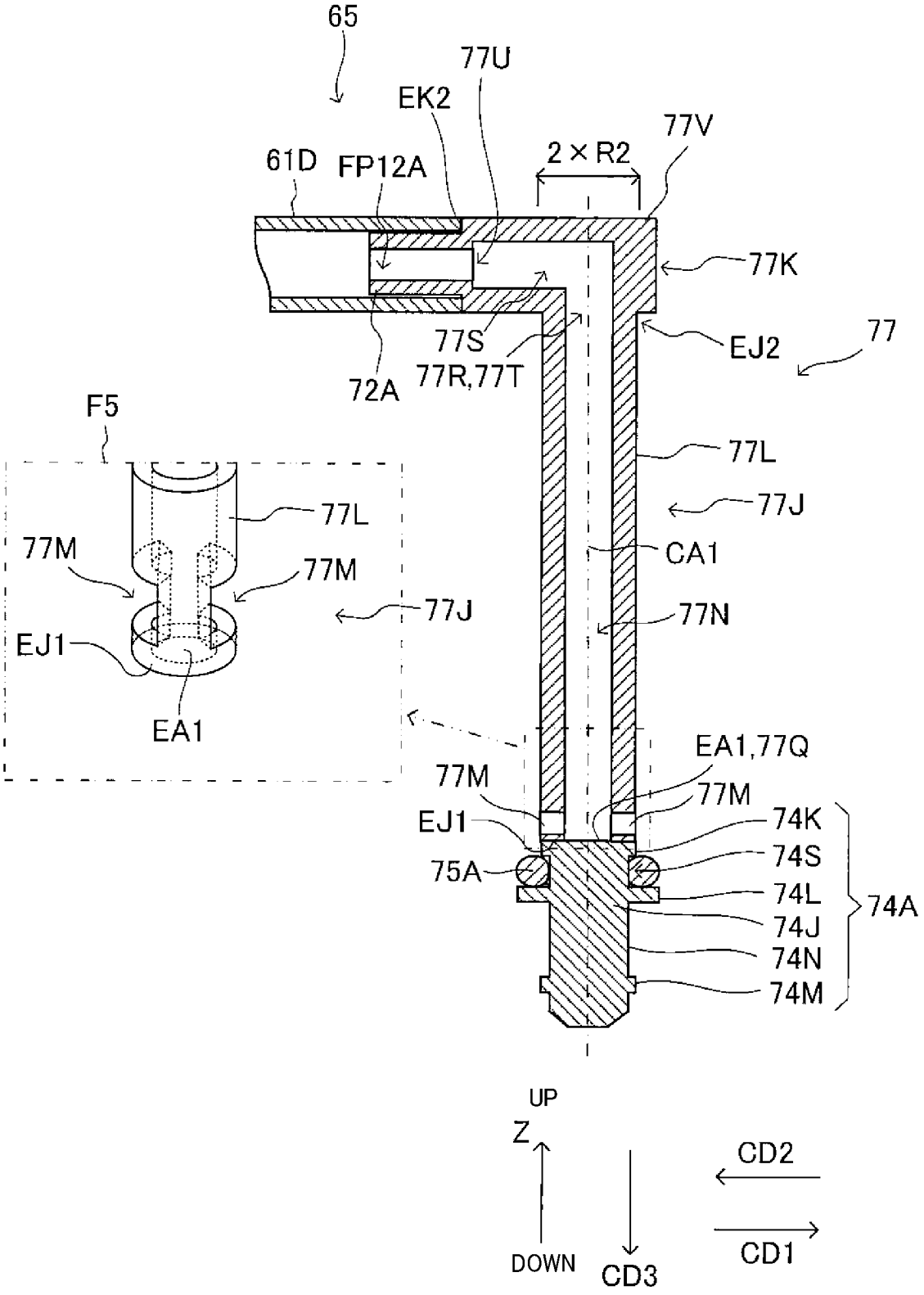
FIG. 13 is a schematic diagram showing a detailed configuration of a flow path member.

Referring to FIG. 13, the flow path portion 77 is made of the hard material. The flow path portion 77 includes a tubular portion 77J and an operation portion 77K.

Figure 14:
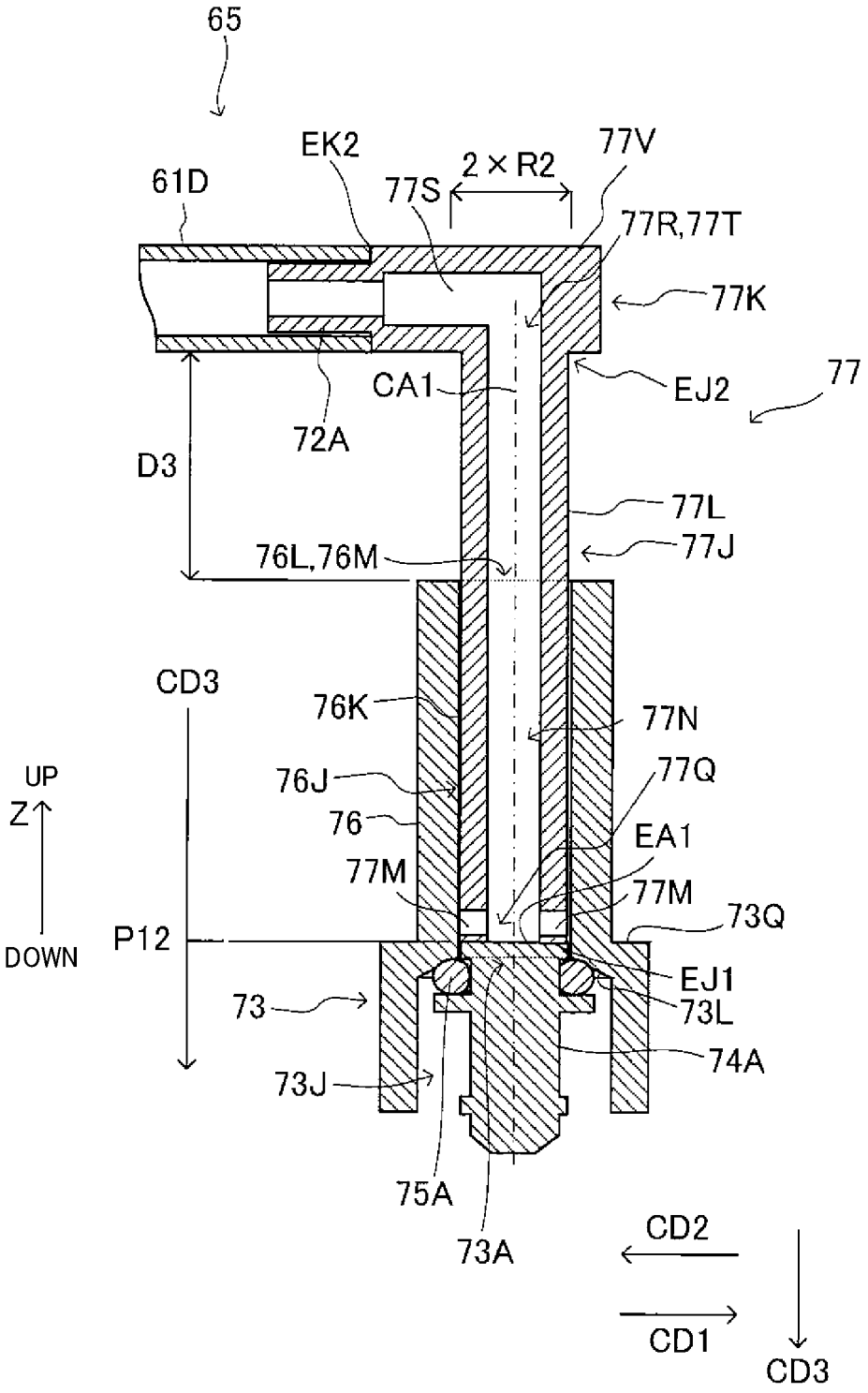
FIG. 14 is a schematic diagram showing the flow path member inserted in the guide portion.

The tubular portion 77J is disposed on the upper side of the first valve element 74A in the height direction Z. The tubular portion 77J has a shape of a tube that extends in the height direction Z. Specifically, a lower end EJ1 of the tubular portion 77J is fixed to the top surface EA1 of the first valve element 74A. The tubular portion 77J extends in the height direction Z from the lower end EJ1. As shown in FIG. 14, the tubular portion 77J is inserted from the first outflow port 73A into the guide path 76J. An outer peripheral surface 77L of the tubular portion 77J is a cylindrical surface whose core axis is the same as the core axis CA1. The diameter of the outer peripheral surface 77L is 2×R2. The tubular portion 77J passes through the guide path 76J and projects out in the height direction Z from the opening 76M of the guide path 76J. Specifically, when the first valve element 74A is located at the closing position P12, an upper end EJ2 of the tubular portion 77J is separated from the opening 76M by a distance D3.

Referring to FIG. 13, the tubular portion 77J has two holes 77M and an upstream side flow path 77N. The holes 77M are through holes formed in the tubular portion 77J at positions close to the lower end EJ1. It is noted that the frame F5 of FIG. 13 schematically shows the holes 77M of the tubular portion 77J and their peripherals viewed from diagonally upward. It is noted that the number of the holes 77M may be at least one. The upstream side flow path 77N is an example of a flow path of the present disclosure. The upstream side flow path 77N communicates with the two holes 77M, and thereby communicates with the valve chamber 73J. The upstream side flow path 77N extends in the height direction Z from the lower end EJ1 of the tubular portion 77J and reaches the upper end EJ2. An upstream end 77Q of the upstream side flow path 77N, namely a lower end, is closed by the top surface EA1 of the first valve element 74A. In addition, a downstream end 77R of the upstream side flow path 77N, namely an upper end, communicates with an upstream end 77T of a downstream side flow path 77S provided in the operation portion 77K.

The operator operates the operation portion 77K to switch the flow path in each ink supply portion 52 from the circulation flow path FP1 (see FIG. 4) to the main flow path FP2. The operation portion 77K is fixed to the upper end EJ2 of the tubular portion 77J. In addition, the operation portion 77K extends from the upper end EJ2 in the centrifugal direction CD1 and reaches an extension end EK2. The size of the operation portion 77K in the centrifugal direction CD1 is larger than 2×R1 (see FIG. 12). The downstream side flow path 77S is formed in the operation portion 77K. The downstream side flow path 77S includes the upstream end 77T and a downstream end 77U, and extends in the centrifugal direction CD1 between the upstream end 77T and the downstream end 77U. The upstream end 77T communicates with the downstream end 77R of the tubular portion 77J. The downstream end 77U communicates with the flow path FP12A of the first outflow side connection portion 72A, at a position corresponding to the extension end EK2.

The first outflow side connection portion 72A projects in the centrifugal direction CD1 from the extension end EK2 of the operation portion 77K. The flow path FP12A is formed in the first outflow side connection portion 72A. The flow path FP12A extends from the downstream end 77U in the centrifugal direction CD1 and passes through the first outflow side connection portion 72A.

Referring to FIG. 8, when the first valve element 74A is located at the opening position P11, the ink in the valve chamber 73J flows through the two holes 77M into the upstream side flow path 77N, passes through the first outflow port 73A, and flows to outside the valve chamber 73J. Here, since the upstream side flow path 77N extends in the height direction Z, the air bubbles in the valve chamber 73J easily flow to outside the valve chamber 73J. Subsequently, the ink flows through the upstream side flow path 77N, the downstream side flow path 77S, and the flow path FP12A (see FIG. 13), and flows out to the flow path member 61D. The flow path member 61D is an example of a second flow path member of the present disclosure, and guides the ink that has flowed out from the first outflow port 73A, to the buffer tank 63. It is noted that when the first valve element 74A is located at the closing position P12 (see FIG. 9), the ink in the valve chamber 73J does not flow in to the upstream side flow path 77N.

Figure 15:
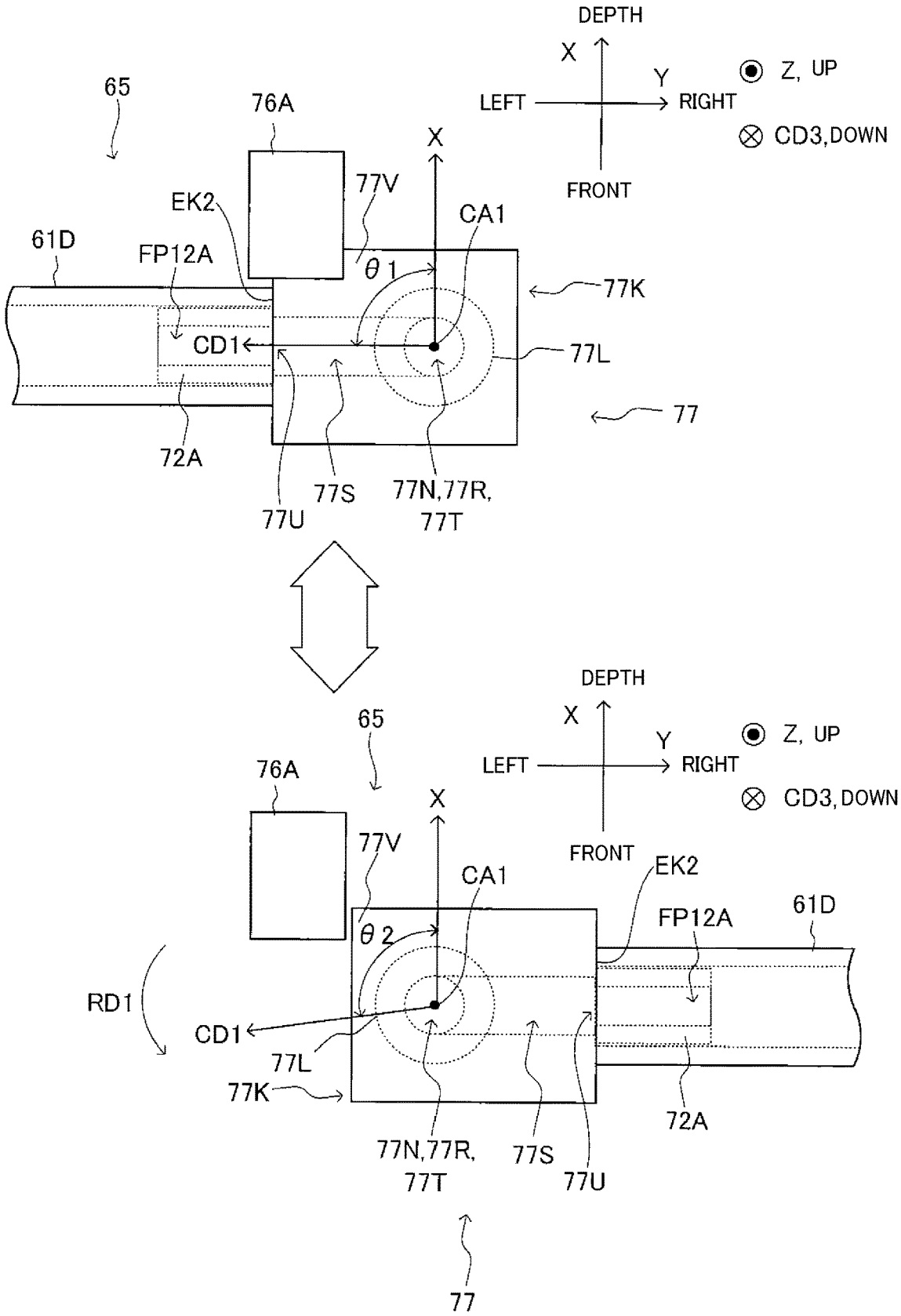
FIG. 15 is a schematic diagram showing a flow path portion located at a first angle position θ1 and a second angle position θ2

The flow path portion 77 is configured to rotate around the core axis CA1 that extends in the inward direction CD3, between a first angle position θ1 and a second angle position θ2 that is different from the first angle position θ1. Specifically, as shown in FIG. 15, at the start of the setup process, the flow path portion 77 is positioned to extend toward the first angle position θ1. Specifically, what extends toward the first angle position θ1 is the downstream side flow path 77S of the operation portion 77K. The first angle position θ1 is a position rotated around the core axis CA1 by a predetermined angle in a predetermined rotation direction RD1 with respect to the depth direction X. As shown in FIG. 6, when the flow path portion 77 is positioned to extend toward the first angle position θ1, the flow path portion 77 is positioned at a predetermined first position P31 in the inward direction CD3 (the height direction Z) by a stopper member 76A. Specifically, what is positioned at the first position P31 is a top surface 77V of the operation portion 77K. The stopper member 76A regulates the position of the top surface 77V so that the operation portion 77K does not move in the height direction Z. The first position P31 corresponds to the opening position P11 of the first valve element 74A and the closing position P21 of the second valve element 74B. Specifically, the first position P31 is a position of the top surface 77V in the inward direction CD3 when the first valve element 74A is located at the opening position P11, and the second valve element 74B is located at the closing position P21.

The biasing member 78 is an example of a biasing member of the present disclosure. The biasing member 78 is a torsion spring or the like, and is, in a state of being inserted in the outer peripheral surface 77L of the flow path portion 77, provided between the operation portion 77K and the guide portion 76. In a no-load state where no load is applied, the biasing member 78 is longer than the distance D3 (see FIG. 14). The biasing member 78 biases the flow path portion 77, more specifically the operation portion 77K, in the height direction Z.

The flow path portion 77 is supported by the guide portion 76 so as to be rotatable around the core axis CA1 in the predetermined rotation direction RD1 (see FIG. 15). After the setup processing portion 7J (see FIG. 4) notifies the end of filling, the operator rotates the flow path portion 77 from the first angle position θ1 to the second angle position θ2 or beyond the second angle position θ2 in the rotation direction RD1 (see FIG. 15). When the flow path portion 77 rotates from the first angle position θ1 to the second angle position θ2, the biasing member 78 displaces the flow path portion 77 from the first position P31 (see FIG. 6) to a second position P32 (see FIG. 7). At this time, the flow path portion 77 is displaced along the guide path 76J to the predetermined second position P32 (see FIG. 7). In other words, the guide portion 76 guides the flow path portion 77 so that the flow path portion 77 is displaced along the guide path 76J from the first position P31 to the second position P32. The second position P32 corresponds to the closing position P12 of the first valve element 74A and the opening position P22 of the second valve element 74B. Specifically, the second position P32 is a position of the top surface 77V in the inward direction CD3 when the first valve element 74A is located at the closing position P12, and the second valve element 74B is located at the opening position P22.

As described above, the flow path portion 77 is displaced both in the rotation direction RD1 and in the height direction Z by the operation of the operator. This makes it possible for the operator to visually recognize the flow path portion 77 to recognize whether the first valve element 74A is located at the opening position P11 or the closing position P12.

While the flow path portion 77 is displaced from the first position P31 to the second position P32 after the valve chamber 73J is filled with ink, the first valve element 74A that is fixed to the operation portion 77K via the tubular portion 77J, is displaced from the opening position P11 toward the first outflow port 73A. In addition, upon reaching the closing position P12, the first valve element 74A closes the first outflow port 73A (see FIG. 7). In addition, since the length of the biasing member 78 in the no-load state is longer than the distance D3, the biasing member 78 continues to bias the flow path portion 77 even after the first valve element 74A is displaced to the closing position P12. As a result, the first seal member 75A is in close contact with the inner upper surface 73L that is the peripheral edge portion, and hermetically seals the first outflow port 73A so that the ink in the valve chamber 73J does not leak therefrom (see the frame F4 of FIG. 9).

Here, while the ink is supplied to the valve chamber 73J during the setup process, the air bubbles in the circulation flow path FP1 move to the buffer tank 63 as the ink flows. In particular, the air bubbles in the valve chamber 73J flow out through the holes 77M formed in the tubular portion 77J. However, part of the air bubbles may be adhered to the inner upper surface 73L of the flow path switching device 65 and remain in the valve chamber 73J. However, during the process where after the notification of the end of filling, the first valve element 74A is displaced from the opening position P11 to the closing position P12, the first seal member 75A applies a force to the air bubbles adhered to the inner upper surface 73L. This allows the air bubbles to move along the inner upper surface 73L toward the first outflow port 73A. In addition, since the two holes 77M formed in the tubular portion 77J pass the side of the upper end EL1 of the inner upper surface 73L, the air bubbles moving toward the first outflow port 73A are discharged from any of the holes 77M to the upstream side flow path 77N, namely to outside the valve chamber 73J.

Referring to FIG. 7, the storage portion 79 has a cylindrical shape. Specifically, the storage portion 79 extends, by a predetermined distance, from a portion of a bottom surface 73R of the casing 73 that is separated from the valve chamber 73J in the inward direction CD3. A storage space 79J is formed in the storage portion 79. The storage space 79J is defined by an inner peripheral surface 79K of the storage portion 79. The inner peripheral surface 79K is a cylindrical surface whose core axis is the same as the core axis CA1 of the valve chamber 73J. The diameter of the inner peripheral surface 79K, namely the diameter of the storage space 79J, is 2×R2. The storage space 79J extends from the second outflow port 73B in the inward direction CD3 by a distance D4. An extension end 79L that is a lower end of the storage space 79J, communicates with the flow path FP12B of the second outflow side connection portion 72B.

The second outflow side connection portion 72B projects from a bottom surface 79M of the storage portion 79 in the inward direction CD3. In the second outflow side connection portion 72B, the flow path FP12B extends from the extension end 79L in the inward direction CD3 and passes through the second outflow side connection portion 72B.

The biasing member 80 is a torsion spring or the like, and the core axis thereof is the same as the core axis CA1 of the valve chamber 73J. The biasing member 80 is stored in the storage space 79J. In the no-load state, the biasing member 80 has a specific length. The specific length is equal to or longer than a distance between the extension end 79L of the storage space 79J and the opening position P22. In addition, the specific length is longer than the distance D4. The biasing member 80 in the state of being stored in the storage space 79J abuts on and is fixed to the bottom surface EB1 of the second valve element 74B. The biasing member 80 biases the second valve element 74B in the height direction Z. It is noted that the biasing member 80 is not fixed to the storage portion 79 so that the flow path portion 77 can rotate in the rotation direction RD1.

The link member 81 is interposed between the first valve element 74A and the second valve element 74B in the valve chamber 73J, and links the first valve element 74A and the second valve element 74B. Specifically, the link member 81 is a torsion spring or the like, and the core axis thereof is the same as the core axis CA1 of the valve chamber 73J. The inner diameter of the link member 81 is the same as the radius R3 of the main body portion 74J. In the no-load state, the length of the link member 81 is equal to or larger than a distance in the inward direction CD3 between the regulating portion 74M of the first valve element 74A located at the opening position P11 and the regulating portion 74M of the second valve element 74B located at the closing position P21. An upper end portion of the link member 81 is inserted in and fixed to a portion of the main body portion 74J of the first valve element 74A that is close to the bottom surface EA2. A lower end portion of the link member 81 is inserted in and fixed to a portion of the main body portion 74J of the second valve element 74B that is close to a top surface EB2. The upper end of the link member 81 abuts on the regulating portion 74M of the first valve element 74A, and the lower end of the link member 81 abuts on the regulating portion 74M of the second valve element 74B.

When the first valve element 74A is displaced from the opening position P11 toward the first outflow port 73A in the valve chamber 73J, the second valve element 74B connected to the first valve element 74A by the link member 81 separates from the second outflow port 73B and opens the second outflow port 73B. It is noted that the link member 81 is not limited to a torsion spring, but may be, for example, a bar-like member connecting the first valve element 74A and the second valve element 74B as far as it can displace the second valve element 74B in response to a displacement of the first valve element 74A.

When the first valve element 74A is located at the opening position P11 (see FIG. 8), the second valve element 74B is biased in the inward direction CD3 by the link member 81, and the second valve element 74B is located at the closing position P21. At this time, the link member 81 applies a force F11 in the inward direction CD3 to the second valve element 74B, and the biasing member 80 applies a force F12 in the height direction Z to the second valve element 74B. Specifications or the like of the biasing member 80 and the link member 81 are determined in advance so that when the second valve element 74B is located at the closing position P21, the force F11 is larger than the force F12, and the second valve element 74B can close the second outflow port 73B.

It is noted that when the first valve element 74A is located at the closing position P12, the link member 81 may bias the first valve element 74A in the height direction Z. In this case, not only a force in the height direction Z that is applied by the biasing member 78 to the operation portion 77K, acts on the first valve element 74A, but also an upward force is applied to the first valve element 74A by the link member 81. This further enhances the contact of the first seal member 75A with the inner upper surface 73L.

In addition, as described with reference to FIG. 13, the flow path portion 77 is fixed to the first valve element 74A. However, not limited to this, the flow path portion 77 may not be fixed to the first valve element 74A. In a case where the flow path portion 77 is not fixed to the first valve element 74A, the link member 81 applies a force in the height direction Z to the first valve element 74A so that the first valve element 74A is displaced from the opening position P11 to the first outflow port 73A while the flow path portion 77 is displaced from the first position P31 to the second position P32.

When the second valve element 74B is located at the closing position P21, the second valve element 74B closes the second outflow port 73B, and the second seal member 75B comes in close contact with the inner lower surface 73M. That is, the second valve element 74B and the second seal member 75B hermetically seal the second outflow port 73B so that the ink in the valve chamber 73J does not leak from the second outflow port 73B (see FIG. 10).

The first valve element 74A is displaced from the opening position P11 (see FIG. 6) to the closing position P12 (see FIG. 7). When the link member 81 is expanded in correspondence with a displacement amount of the first valve element 74A, the force applied to the second valve element 74B by the link member 81 reduces. The biasing member 80 is expanded such that the forces applied to the second valve element 74B by the biasing member 80 and the link member 81 are balanced. This allows the second valve element 74B to be separated from the closing position P21 in the height direction Z and start opening the second outflow port 73B. Subsequently, the second valve element 74B reaches the opening position P22. That is, when the valve chamber 73J is filled with the ink, the second valve element 74B opens the second outflow port 73B. This allows the flow path in the ink supply portion 52 to be switched from the circulation flow path FP1 to the main flow path FP2.

The feed portion 64 continues to be driven even after the second valve element 74B is displaced to the opening position P22, and the ink in the valve chamber 73J is fed to the recording head 41 through the second outflow port 73B, the flow path FP12B, and the flow path member 61E. In each recording head 41, the preservation solution is discharged, together with the ink, from the ink ejection portions 41J. When a specific time period elapses after the flow path is switched to the main flow path FP2, the setup processing portion 7J determines that the ink and the preservation solution have been discharged completely from the recording heads 41 and stops driving the feed portion 64. The setup process ends with this, and the recording apparatus 100 becomes ready to record the image. That is, when the specific time period elapses after the second valve element 74B opens the second outflow port 73B, the recording heads 41 become ready to record the image on the recording object M1 with the ink that flows out from the second outflow port 73B.

Figure 16:
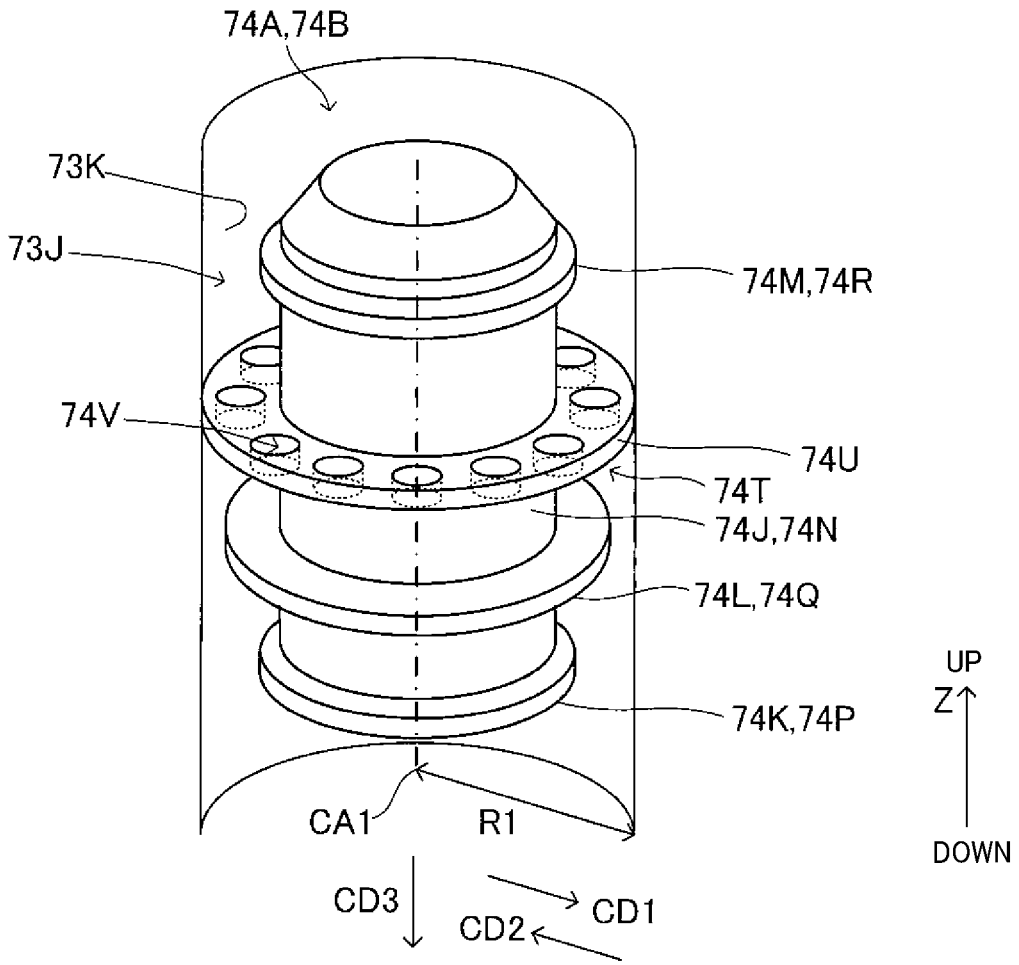
FIG. 16 is a schematic diagram showing another configuration example of the first valve member and the second valve member.

It is noted that as described above with reference to FIG. 13, the flow path portion 77 is fixed to the first valve element 74A. However, not limited to this, the flow path portion 77 may not be fixed to the first valve element 74A. Specifically, the lower end EJ1 of the tubular portion 77J may not be fixed to the top surface EA1 of the first valve element 74A. In this case, it becomes easy for the first valve element 74A or the second valve element 74B (see FIG. 6, FIG. 7) to be shifted in the centrifugal direction CD1 in the valve chamber 73J, and this makes it difficult for the first valve element 74A to close the first outflow port 73A, or the second valve element 74B to close the second outflow port 73B. As a result, at least one of the first valve element 74A and the second valve element 74B further includes an abutting portion 74T, as shown in FIG. 16.

The abutting portion 74T projects in the centrifugal direction CD1 to form a flange-like shape from a position on the outer peripheral surface 74N that is different from positions of the small diameter regulating portion 74K, the large diameter regulating portion 74L, and the regulating portion 74M in the inward direction CD3. Specifically, the abutting portion 74T projects from a position on the outer peripheral surface 74N that is between the large diameter regulating portion 74L and the regulating portion 74M.

The abutting portion 74T includes an outer peripheral surface 74U. The outer peripheral surface 74U is a cylindrical surface having the core axis CA1 The radius of the outer peripheral surface 74U is the same as the radius R1 of the valve chamber 73J. With this configuration, when the first valve element 74A or the second valve element 74B including the abutting portion 74T is displaced in the inward direction CD3 in the valve chamber 73J, the abutting portion 74T is displaced while abutting on the inner peripheral surface 73K. This prevents the first valve element 74A or the second valve element 74B including the abutting portion 74T from shifting in the centrifugal direction CD1 in the valve chamber 73J. It is noted that for convenience's sake, only a part of the first valve element 74A, the second valve element 74B, and the inner peripheral surface 73K is shown in FIG. 16.

The abutting portion 74T has a plurality of through holes 74V piercing through the abutting portion 74T in the inward direction CD3. It is noted that in FIG. 16, the reference sign "74V" is placed at only one through hole. With the plurality of through holes 74V formed in the abutting portion 74T, it is possible to circulate the ink that has flowed through the inflow port 73N (see FIG. 6, FIG. 7) to the valve chamber 73J, to the first outflow port 73A or the second outflow port 73B.

It is noted that the first valve element 74A or the second valve element 74B may not include the abutting portion 74T, and the large diameter regulating portion 74L or the regulating portion 74M may have the shape of the abutting portion 74T. However, as shown in FIG. 9, when the first seal member 75A is in close contact with the inner upper surface 73L, the large diameter regulating portion 74L is pressed by the first seal member 75A. In addition, the regulating portion 74M is biased by the link member 81. That is, an external force that is larger than a pressure given by the ink is applied to the large diameter regulating portion 74L and the regulating portion 74M. As a result, the large diameter regulating portion 74L and the regulating portion 74M need to have resistance against the external force, namely need to have high rigidity. Accordingly, it is preferable that the through holes are not formed in the large diameter regulating portion 74L and the regulating portion 74M. As a result, it is preferable that the first valve element 74A or the second valve element 74B includes the abutting portion 74T as well as the large diameter regulating portion 74L and the regulating portion 74M.

The abutting portion 74T may not project from the outer peripheral surface 74N in the centrifugal direction CD1 to form a flange-like shape. Instead, the abutting portion 74T may have a plurality of portions projecting in a fin shape from the outer peripheral surface 74N in a plurality of centrifugal directions CD1 that are different from each other.

As described above with reference to FIG. 6, the first outflow port 73A is formed at the upper end of the valve chamber 73J in the height direction Z. In addition, as described above with reference to FIG. 13, the upstream side flow path 77N extends in the height direction Z. However, not limited to this, the first outflow port 73A may be formed at a position that is the same as or higher than the position of the inflow port 73N in the height direction Z. In addition, the upstream side flow path 77N may extend in the centrifugal direction CD1.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An inkjet recording apparatus comprising:

a reserve portion in which ink is reserved;

a casing in which an inflow port, a valve chamber, a first outflow port, and a second outflow port are formed, wherein the inflow port communicates with the reserve portion, the ink that has flowed out from the reserve portion flows into the valve chamber through the inflow port, and the first outflow port and the second outflow port are capable of flowing out the ink from the valve chamber;

a first valve element preliminarily located at an opening position that is separated from the first outflow port in an inward direction that is directed from the first outflow port toward inside of the valve chamber, the first valve element configured to be displaced from the opening position to the first outflow port so as to close the first outflow port when the valve chamber is filled with the ink;

a second valve element preliminarily located at a closing position closing the second outflow port, the second valve element configured to be displaced separately from the first valve element and open the second outflow port when the valve chamber is filled with the ink;

a recording head which becomes ready to record an image on a recording object with the ink that flows out through the second outflow port after the second outflow port is opened by the second valve element;

a guide portion in which a guide path is formed, the guide path extending from the first outflow port in an outward direction opposite to the inward direction, wherein an extension end of the guide path is an opening opened toward the outward direction;

a flow path portion disposed on the outward direction side of the first valve element, the flow path portion passing through the guide path and projects out from the opening of the guide path; and a biasing member configured to bias the flow path portion in the outward direction, wherein a flow path is formed in the flow path portion, the flow path being communicable with the valve chamber and extending in the outward direction, the guide portion guides the flow path portion such that the flow path portion is displaced along the guide path from a first position corresponding to the opening position to a second position corresponding to a position of the first valve element closing the first outflow port, while the flow path portion is displaced from the first position to the second position, the first valve element is displaced from the opening position and closes the first outflow port, the flow path portion is configured to rotate around a core axis that extends in the inward direction, between a first angle position and a second angle position that is different from the first angle position, when the flow path portion is at the first angle position, the flow path portion is not allowed to be displaced from the first position to the second position, and when the flow path portion is at the second angle position, the flow path portion is allowed to be displaced between the first position and the second position.

2. The inkjet recording apparatus according to claim 1, wherein the inward direction is a downward direction.

3. The inkjet recording apparatus according to claim 1, further comprising:

a first flow path member configured to guide the ink reserved in the reserve portion to the inflow port; and a second flow path member configured to guide the ink that has flowed out from the first outflow port, to the reserve portion.

4. The inkjet recording apparatus according to claim 1, further comprising:

a spring member linking the first valve element and the second valve element, wherein when the first valve element is displaced toward the first outflow port, the second valve element that is linked with the first valve element by the spring member, is separated from the second outflow port and opens the second outflow port.

5. The inkjet recording apparatus according to claim 4, wherein when the first valve element closes the first outflow port, the spring member biases the first valve element in the outward direction.

6. The inkjet recording apparatus according to claim 1, further comprising:

a spring member linking the first valve element and the second valve element, wherein in a case where the flow path portion is not fixed to the first valve element, while the flow path portion is displaced from the first position to the second position, the spring member displaces the first valve element from the opening position to the first outflow port by applying a force in the outward direction.

7. The inkjet recording apparatus according to claim 1, further comprising:

a seal member configured to, when the first valve element closes the first outflow port, come in close contact with a peripheral edge portion of the casing that surrounds the first outflow port.

8. The inkjet recording apparatus according to claim 7, wherein the inward direction is a downward direction, and the peripheral edge portion is an annular surface that is inclined with respect to the inward direction, and a diameter of the peripheral edge portion increases as it goes from the first outflow port in the inward direction.

* * * * *